US007487963B2

(12) United States Patent
Shiohara et al.

(10) Patent No.: US 7,487,963 B2
(45) Date of Patent: Feb. 10, 2009

(54) IMAGE FORMING APPARATUS WITH A SHEET SUPPLYING UNIT WITH MULTIPLE SUPPORTS

(75) Inventors: Yukio Shiohara, Nagoya (JP); Tetsuo Asada, Kuwana (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 30 days.

(21) Appl. No.: 11/181,998

(22) Filed: Jul. 15, 2005

(65) Prior Publication Data

US 2006/0012105 A1 Jan. 19, 2006

(30) Foreign Application Priority Data

Jul. 16, 2004 (JP) ..... 2004-209600

(51) Int. Cl.
*B65H 1/00* (2006.01)

(52) U.S. Cl. ..... 271/171; 271/162

(58) Field of Classification Search ..... 271/145, 271/161, 162, 164, 171
See application file for complete search history.

(56) References Cited

U.S. PATENT DOCUMENTS

| | | | | |
|---|---|---|---|---|
| 4,565,360 | A * | 1/1986 | Runzi | 271/4.04 |
| 5,085,422 | A * | 2/1992 | Sagara | 271/162 |
| 5,162,838 | A | 11/1992 | Inuzuka et al. | |
| 5,347,349 | A * | 9/1994 | Sato et al. | 399/392 |
| 5,887,226 | A * | 3/1999 | Taki | 399/92 |
| 6,042,109 | A * | 3/2000 | Klausbruckner | 271/225 |
| 6,113,093 | A * | 9/2000 | Morinaga et al. | 271/162 |
| 6,331,002 | B1 * | 12/2001 | Yoshino et al. | 271/117 |
| 6,651,974 | B2 * | 11/2003 | Kawarama et al. | 271/121 |
| 6,942,211 | B2 * | 9/2005 | Teo et al. | 271/145 |
| 7,059,597 | B2 * | 6/2006 | Shirakura et al. | 271/171 |
| 7,435,025 | B2 * | 10/2008 | Tanahashi et al. | 400/625 |
| 7,437,119 | B2 * | 10/2008 | Takemoto et al. | 399/393 |
| 2006/0071404 | A1 * | 4/2006 | Kozaki | 271/145 |
| 2007/0201921 | A1 * | 8/2007 | Asada et al. | 399/393 |

FOREIGN PATENT DOCUMENTS

| | | |
|---|---|---|
| JP | 4083460 | 3/1992 |
| JP | 2003285964 | 10/2003 |

OTHER PUBLICATIONS

Hewlett-Packard Company, HP Officejet 630 All-in-One: Manuals, 1997, http://h10032.www1.hp.com/ctg/Manual/bpu60078.pdf, p. 1-6.*

* cited by examiner

*Primary Examiner*—Patrick H Mackey
*Assistant Examiner*—Gerald W McClain
(74) *Attorney, Agent, or Firm*—Banner & Witcoff, Ltd.

(57) ABSTRACT

An image forming apparatus includes: a sheet supplying unit that accommodates a sheet and has a bottom surface on which the sheet is placed and a supporting portion disposed above the bottom surface, the bottom surface having an auxiliary support unit; a transport unit that transports the sheet from the sheet supplying unit while turning over the sheet; and a recording unit that performs recording on the sheet transported by the transport unit. The auxiliary support unit is extendable and retractable with respect to the bottom surface along a traveling direction of the sheet and is capable of supporting the sheet transported from the recording unit in cooperation with the supporting portion.

26 Claims, 13 Drawing Sheets

IMAGE FORMING APPARATUS WITH A SHEET SUPPLYING UNIT WITH MULTIPLE SUPPORTS

BACKGROUND OF THE INVENTION

1. Field of the Invention

The present invention relates to an image forming apparatus in which a cover that covers a top opening of a case for accommodating recording sheets used for a copier, a facsimile machine, a printer, or the like is used as a sheet ejection tray.

2. Description of the Related Art

Multifunction machines having at least two of such functions as a scanner function for reading a document and generating image data, a facsimile function for transmitting and receiving image data via a communication line, a printer function for recording image data transmitted from an external apparatus such as a personal computer, and other functions are commonly known. For example, a multifunction machine in which an image reading unit having a flatbed is provided above an ink-jet recording type image recording unit is known. In this image recording unit, a recording sheet that is sent out from a sheet supplying unit is transported through a transport passage by a transport unit, ink is ejected from a recording head and printing is thereby performed onto the recording sheet, and the recording sheet is ejected by an ejecting unit to a sheet ejection tray that is disposed between the image reading unit and the sheet supplying unit (refer to JP-A-2003-285964).

In another multifunction machine, a cassette cover of a recording sheet cassette is used as a sheet ejection tray for recorded cut sheets on which recording has been performed by a recording unit (refer to JP-A-4-83460).

SUMMARY OF THE INVENTION

In the related art, a pick-up unit for picking up the top one of recording sheets accommodated in the cassette is provided in the machine main body so as to be elevated and lowered. Therefore, it is necessary that an opening be formed in a sheet-supplying-side top portion of the cassette so that no obstruction exists to attachment or detachment of the cassette and elevation or lowering of the pick-up unit. That is, it is impossible for the cassette cover to close the entire top portion of the cassette.

In recent years, to reduce the machine installation area, a design has come to be employed in which the recording unit is provided so as to overlap with the space over the cassette and an ejection opening is disposed on the front side of the recording unit. As a result, a portion of the cassette cover which also serves as the sheet ejection tray becomes short and sheets stacked thereon are prone to fall off.

One counter measure is to provide an auxiliary tray that is extended by sliding the cassette cover to a sheet-discharging-side in the transport direction or that is rotated to serve as an extension of the sheet ejection tray. However, to provide a slide mechanism, the cover should be thick enough to accommodate the auxiliary tray. This decreases the maximum number of sheets that can be set (loaded) in the sheet supplying unit. Also, this makes it impossible to secure a sufficient height of the front opening space of the machine main body where the sheet ejection tray is disposed, as a result of which recorded sheets are hard to take out.

Where the auxiliary tray as an extendable auxiliary support unit is extended by rotating it, the image reading unit should not overlap with the rotation locus of the auxiliary tray. Therefore, the auxiliary tray is made short enough not to touch the image reading unit.

The present invention provides an image forming apparatus in which the height of the apparatus is reduced efficiently and an auxiliary support unit can support recorded sheets reliably.

According to one aspect of the invention, there is provided an image forming apparatus including: a sheet supplying unit that accommodates a sheet and has a bottom surface on which the sheet is placed and a supporting portion disposed above the bottom surface, the bottom surface having an auxiliary support unit; a transport unit that transports the sheet from the sheet supplying unit while turning over the sheet; and a recording unit that performs recording on the sheet transported by the transport unit. The auxiliary support unit is extendable and retractable with respect to the bottom surface along a traveling direction of the sheet and is capable of supporting the sheet transported from the recording unit in cooperation with the supporting portion.

According to another aspect of the invention, there is provided a sheet supplying unit for use in an image forming apparatus to accommodate a sheet, including: a bottom surface on which the sheet is placed; and a supporting portion disposed above the bottom surface, the bottom surface having an auxiliary support unit. The auxiliary support unit is extendable and retractable with respect to the bottom surface along a traveling direction of the sheet and is capable of supporting the sheet transported from the bottom surface in cooperation with the supporting portion.

According to the above structure, sheets transported from the recording unit can be supported reliably. Further, extending the auxiliary support unit makes it possible to reliably support leading edges of recorded sheets that project from an apparatus main body.

BRIEF DESCRIPTION OF THE DRAWINGS

The present invention may be more readily described with reference to the accompanying drawings.

DETAILED DESCRIPTION OF THE PREFERRED EMBODIMENTS

An embodiment of the present invention will be hereinafter described with reference to the drawings.

Figure 1:
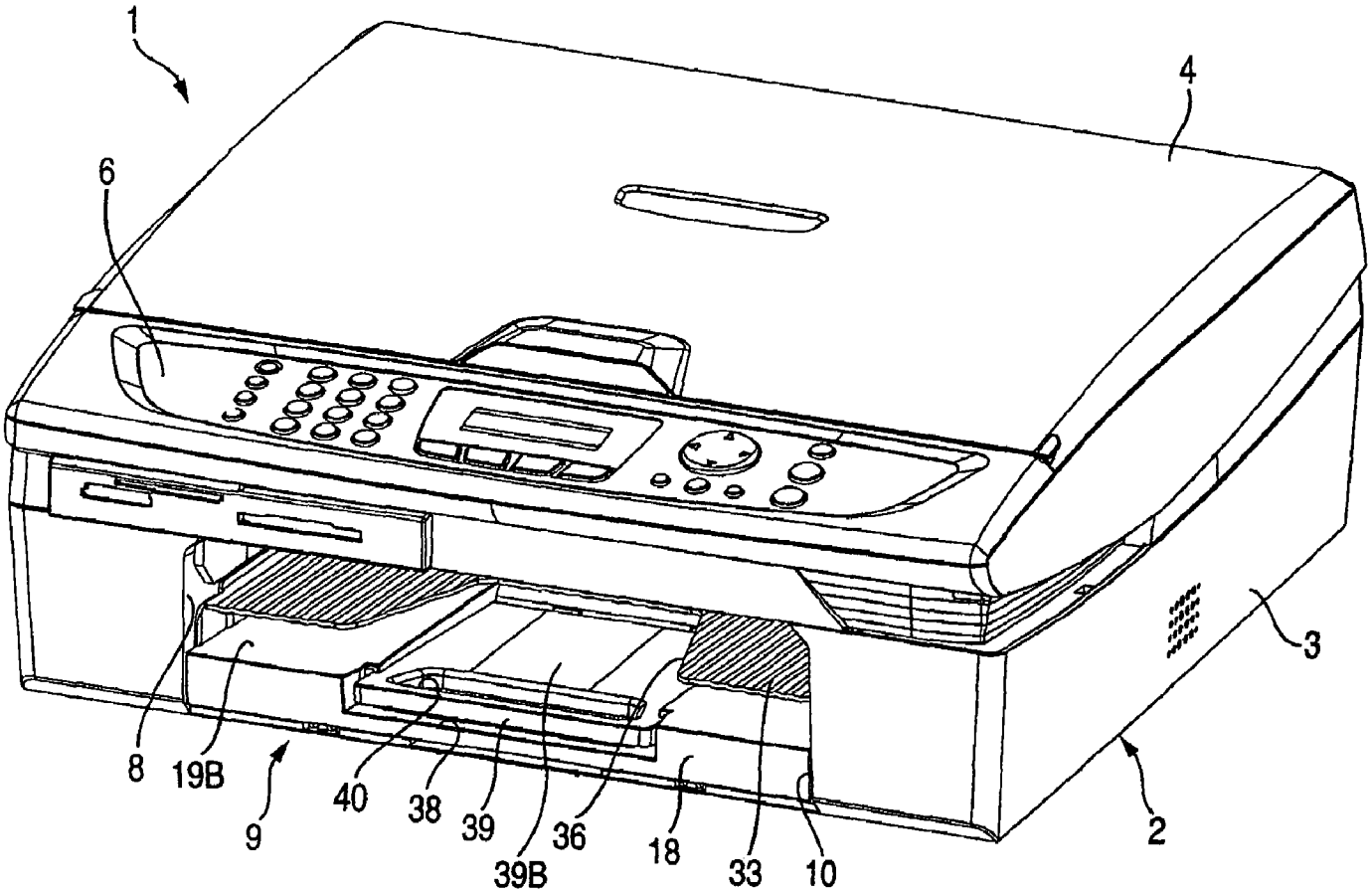
FIG. 1 is a perspective view of an image recording apparatus 1 according to an embodiment of the present invention.
Figure 2:
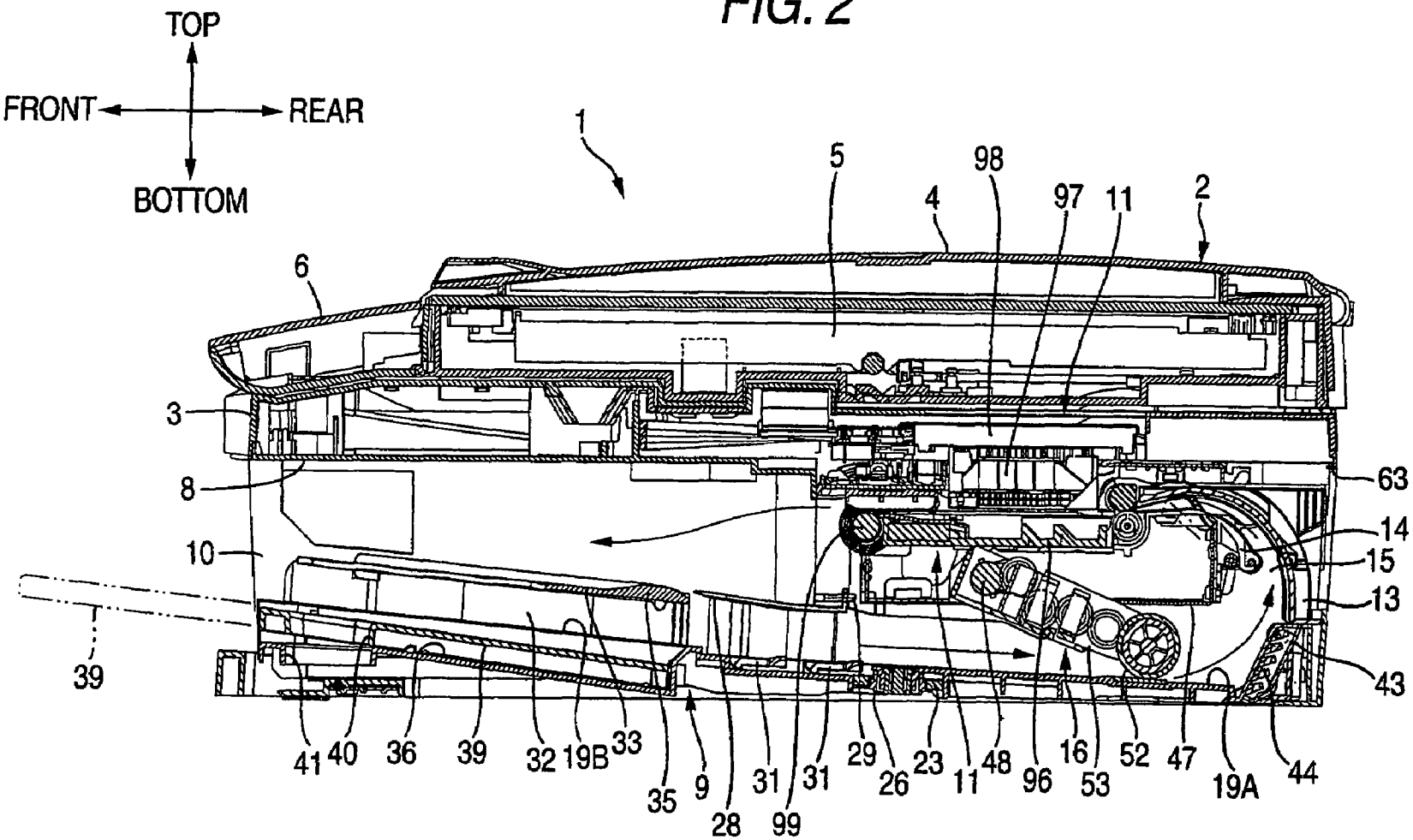
FIG. 2 is a sectional view of the image recording apparatus.

FIG. 1 is a perspective view showing an appearance of an image recording apparatus 1 according to the embodiment, and FIG. 2 is a sectional view of the image recording apparatus 1. In the following description, as for the vertical direction, the term "top" and "bottom" will be used in a manner as seen in FIG. 2. As for the front-rear direction, the left side in FIG. 2 is defined as the front side.

The image recording apparatus 1 according to the embodiment is a multifunction machine having a facsimile function, a printer function, a copier function, a scanner function, etc. The image recording apparatus 1 has a casing 2 that generally assumes a box shape as a whole. When viewed from above, the casing 2 assumes a generally square shape whose sidelines are one size longer than the longitudinal length of the A4-size sheet. The casing 2 is divided into a generally box-shaped apparatus main body 3 and a cover body 4 that covers the apparatus main body 3 from above. The cover body 4 can be opened and closed relative to the apparatus main body 3 and is equipped with a reading unit 5 for reading an image, an operating panel 6, etc.

The apparatus main body 3 has, at the center in the width direction, an opening portion 8 having an opening on the front side. A bottom portion of the opening portion 8 is a tray accommodation portion 10 capable of accommodating a supply tray 9 to be loaded with sheets such as sheets of paper or OHP sheets (not shown). A recording unit 11 for forming an image on a sheet is disposed behind the opening portion 8 above the tray accommodation portion 10. An outside arc-shaped guide 13 and an inside arc-shaped guide 14 are disposed behind the recording unit 11, and a U-shaped transport passage 15 that connects the tip of the supply tray 9 in the tray accommodation portion 10 and the rear end of the recording unit 11 is formed between the two arc-shaped guides 13 and 14. A pick-up unit 16 for supplying the recording unit 11 with sheets that are loaded on the supply tray 9 is disposed between the recording unit 11 and the supply tray 9. In the image recording apparatus 1, as indicated by an arrow in FIG. 2, a sheet that is loaded on the supply tray 9 is sent to the transport passage 15 by the pick-up unit 16 and reaches the recording unit 11 past the transport passage 15. After a prescribed image is recorded on the sheet in the recording unit 11, the sheet is ejected to a front portion of the top surface of the supply tray 9. A driving unit (not shown) for driving the pick-up unit 16, etc., a control circuit (not shown) for controlling operation of individual units and components, and other units and components are provided inside the apparatus main body 3.

Next, the configurations of the individual units and components will be described.

Figure 3:
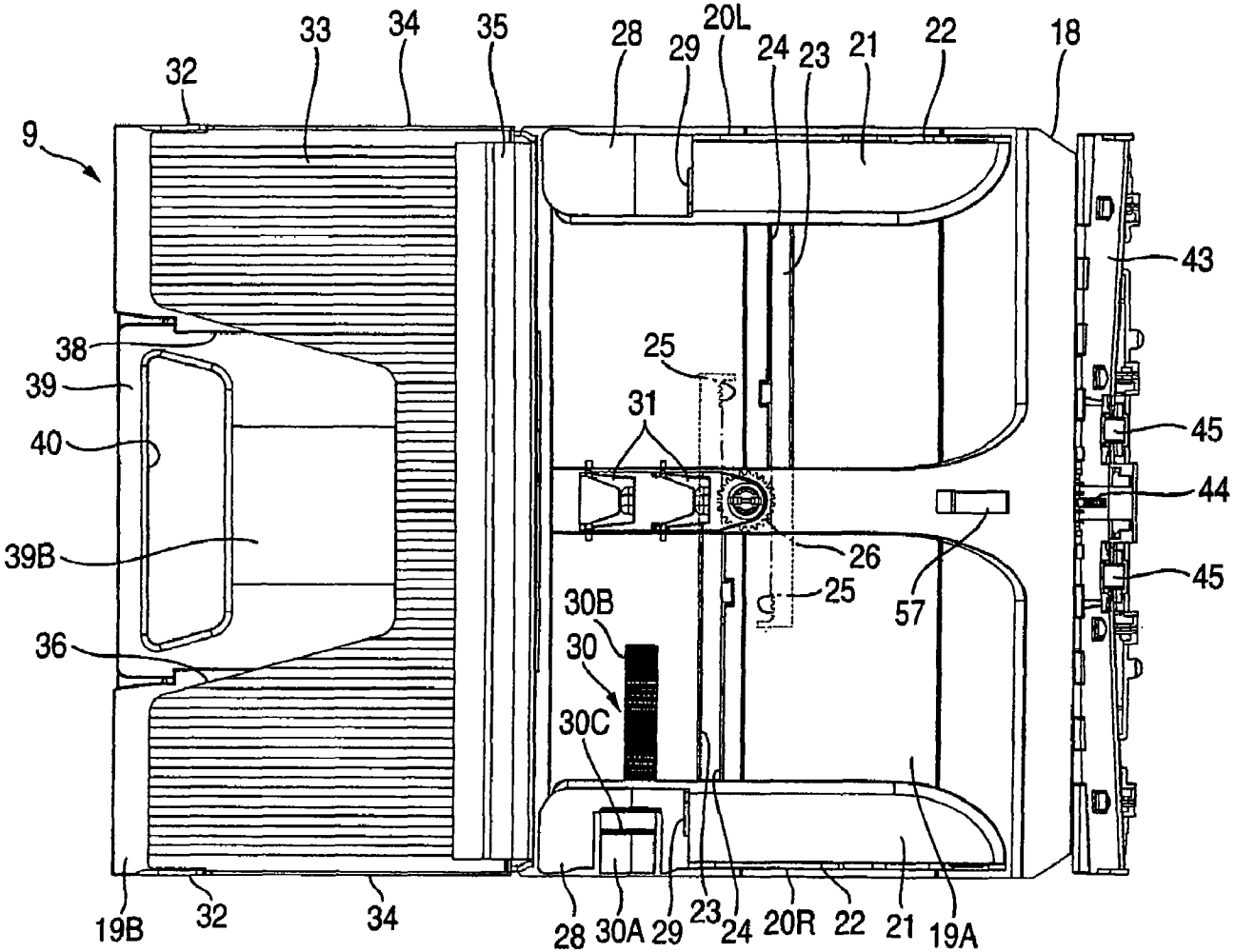
FIG. 3 is a plan view of a supply tray.
Figure 4:
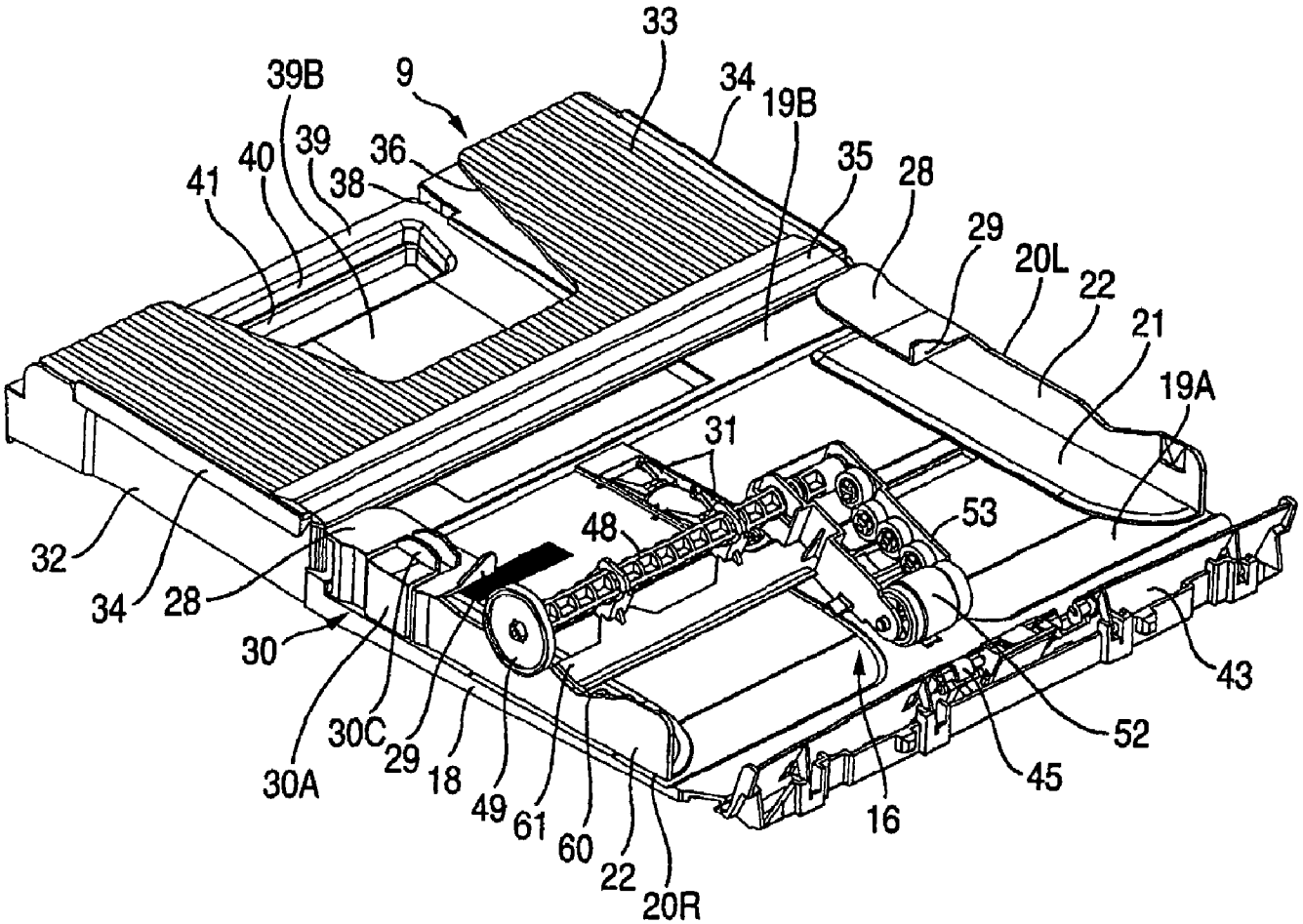
FIG. 4 is a perspective view of the supply tray and a pick-up unit.

First, the supply tray 9 will be described with reference to FIGS. 3, 4, etc. FIG. 3 is a plan view of the supply tray 9 and FIG. 4 is a perspective view of the supply tray 9 and the pick-up unit 16 that is provided on the apparatus main body 3. The supply tray 9 can be removed from the apparatus main body 3 by pulling it out horizontally from the above-mentioned tray accommodation portion 10 to the front side, and can be accommodated in the apparatus main body 3 again by inserting the removed supply tray 9 into the tray accommodation portion 10 horizontally. The supply tray 9 has a rectangular bottom plate 18 and assumes a shallow dish shape as a whole that has an approximately A4-size when viewed from above. The top surface of the bottom plate 18 can be loaded with sheets, and its approximately rear half portion and approximately front half portion are a rear loading surface 19A and a front loading surface 19B, respectively. Each of the two loading surfaces 19A and 19B is inclined in such a manner that its rear side, that is, its downstream side in the sheet supply direction is lower. The inclination angle of the front loading surface 19B is larger than that of the rear loading surface 19A (see FIG. 2).

A pair of side end guides 20R and 20L are formed on the rear loading surface 19A so as to be spaced from each other in the right-left direction. Each of the side end guides 20R and 20L has a bottom wall 21 that is parallel with the rear loading surface 19A and extends from a position a little deviated to the front side from the rear end of the rear loading surface 19A to a position close to the front end of the rear loading surface 19A. A guide wall 22 erects vertically from the outside (in the width direction of the bottom plate 18) edge of each bottom wall 21 so as to extend in the front-rear direction (sheet supply direction) over the same length as the bottom wall 21 does. A linear guide bar 23 extends from the bottom surface of each bottom wall 21 toward the other side end guide 20R or 20L. The linear guide bars 23 are arranged parallel with each other with a prescribed gap formed in the front-rear direction and are fitted in respective grooves 24 that are formed in the bottom plate 18 so as to extend in the right-left direction. The two side end guides 20R and 20L can be displaced in the right-left direction (i.e., in the direction perpendicular to the sheet supply direction) by sliding the linear guide bars 23 along the grooves 24 while keeping the bottom walls 21 in sliding contact with the rear loading surface 19A. Confronting portions of the two linear guide bars 23 are formed with respective rack gears 25, which are in mesh with a pinion gear 26 that is provided rotatably on the bottom plate 18 at the center in the width direction. Linked to each other via the rack gears 25 and the pinion gear 26, the two side end guides 20R and 20L operate in an interlocked manner so that the distances between the two guide walls 22 and the center of the bottom plate 18 in the width direction are always kept identical. When the two side end guides 20R and 20L are separated from each other to have the maximum width (the state of FIG. 3), the interval between the two guide walls 22 is made approximately equal to the shorter-side dimension (width) of the A4-size sheet.

An overhang (roof) 28 extends from a top-front portion of the guide wall 22 of each of the two side end guides 20R and 20L above the bottom wall 21. A stopper 29 or sheet blocking portion erects approximately vertically from the rear end of each overhang 28. Located below an ejection roller 99 (described later), the stoppers 29 prevent a backward movement of ejected sheets that are placed on the overhangs 28. A position adjustment portion 30 for positioning the two side end guides 20R and 20L at prescribed positions is disposed in a front portion of the right-hand side end guide 20R. The position adjustment portion 30 has an elastic piece 30A having a bracket-shaped cross section. The walls of the position adjustment portion 30 are parallel with the surfaces of the bottom wall 21, the guide wall 22, and the overhang 28, respectively. In a state that no external force is exerted on the elastic piece 30A, a lock projection (not shown) formed on the bottom surface of the elastic piece 30A is locked with a slip preventing portion 30B having asperities that is formed on the rear loading surface 19A so as to extend in the right-left direction, whereby the side end guides 20R and 20L are positioned. When a manipulation portion 30C that is provided on top of the elastic piece 30A is gripped, flexural deformation occurs in the elastic piece 30A and the above-mentioned lock projection is unlocked from the slip preventing portion 30B. As a result, the two side end guides 20R and 20L can be displaced in the right-left direction.

A pair of positioning ribs 31 capable of erecting and falling down are provided on the rear loading surface 19A at the center in the width direction so as to be arranged in the front-rear direction. Erecting one of the positioning ribs 31 makes it possible to position a postcard-size sheet, an L-size sheet (89×127 mm), or the like between itself and a guide plate 43 (described later) that is disposed at the rear end of the rear loading surface 19A.

Fixed side walls 32 erect vertically from the two side ends of the front loading surface 19B of the bottom plate 18 so as to extend in the front-rear direction. The fixed side walls 32 are disposed so as to be approximately flush with the respective guide walls 22 when the two side end guides 20R and 20L are separated from each other to have the maximum width. A cover 33 capable of covering, from above, sheets placed on the bottom plate 18 extends so as to bridge the top surfaces of the two fixed side walls 32. The cover 33 has fitting flanges 34 at both side ends, and the two fixed side walls 32 are fitted with the cover 33 placed from above. Therefore, the cover 33 can be detached from the two fixed side walls 32. The cover 33 is inclined toward the rear side as a whole so as to be approximately parallel with the front loading surface 19B. The top surface of the cover 33 is formed with a bulge 35 that extends along the rear end of the cover 33. The front ends of the overhangs 28 of the above-mentioned side end guides 20R and 20L are approximately at the same level in the vertical direction as the top of the bulge 35. When ejected sheets are taken out and then part of them are placed on the cover 33 again (the other part are removed), this height relationship prevents recorded sheets from being inserted into the cassette. Further, the cover 33 is formed with, at the center in the width direction, a cut 36 that is open on the front side. An operator can take out small sheets such as L-size sheets from the supply tray 9 by inserting his or her hand through the cut 36.

A detailed description will be made of displacement of an auxiliary support member 39 in the front-rear direction. The front loading surface 19B of the bottom plate 18 is formed with, approximately at the center in the width direction, a rectangular support member accommodation hole (recess) 38 that is open on the front side. A plate-like auxiliary support member 39 that is also rectangular in a plan view is accommodated in the support member accommodation hole 38. In the accommodated state, the top surface of the auxiliary support member 39 is flush with the front loading surface 19B. A finger hook hole 40 that is long in the right-left direction and penetrates through the auxiliary support member 39 in the vertical direction is formed close to the front end of the auxiliary support member 39 approximately at the center in the right-left direction. The bottom surface of the support member accommodation hole 38 is formed with a second finger hook hole 41 at the position corresponding to the finger hook hole 40.

Figure 13A:
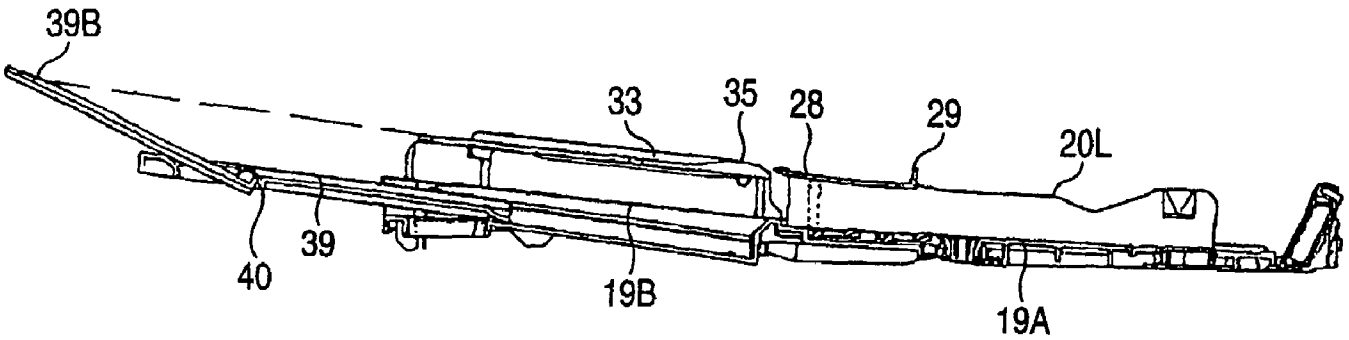
FIGS. 13A and 13B are sectional views showing a state that an auxiliary support member is extended and a state that it is retracted, respectively.

FIG. 13A is a sectional view showing a case of accommodating long sheets such as legal-size sheets. An operator inserts his or her fingers into the finger hook hole 40 of the auxiliary support member 39 and pulls out the auxiliary support member 39 from the support member accommodation hole 38 along guide rails (not shown). The auxiliary support member 39 is fixed in a pulled-out state because it is engaged with an engagement piece (not shown) that is formed at the front end of the support member accommodation hole 38. In this state, the auxiliary support member 39 serves as part of the front loading surface 19B on which long sheets such as legal-size sheets are to be placed. Further, an extension tray 39B is rotated so as to be located on the front side of the auxiliary support member 39 in a retractable manner. In the state that the auxiliary support member 39 is pulled out, the extension tray 39B can be rotated with the rear end of the finger hook hole 40 as a pivot until it hits the front end of the finger hook hole 40. In the state that the extension tray 39B is in contact with the front end of the finger hook hole 40, a tip portion of the extension tray 39B intersects a plane (indicated by an imaginary line in the figure) containing the cover 33. Therefore, leading edges of ejected sheets are supported by the extension tray 39B. As such, together with the cover 33 and the overhangs 28, the extension tray 39B supports recorded sheets in such a manner that they are approximately flat. On one hand, the auxiliary support member 39 serves as part of the supply tray 9. On the other hand, the extension tray 39B that extends from the auxiliary support member 39 forms a sheet ejection tray together with the cover 33 and the overhangs 28. In this state, the height of the cover 33 with respect to the front loading surface 19B is set great enough to allow leading edges of recorded sheets ejected from the ejection roller 99 to go over the auxiliary support member 39 on which long sheets are placed and to touch the extension tray 39B. Therefore, the auxiliary support member 39 serves as a supply/ejection tray, and provides high stacking performance for recorded sheets because ejected recorded sheets do not touch unrecorded sheets placed thereon. Although in the embodiment the auxiliary support member 39 can slide parallel with the front loading surface 19B, the auxiliary support member 39 may be disposed so as to be able to slide obliquely upward with respect to the front loading surface 19B and to intersect the plane containing the top surface(s) of the cover 33 or the overhangs 28.

Figure 13B:
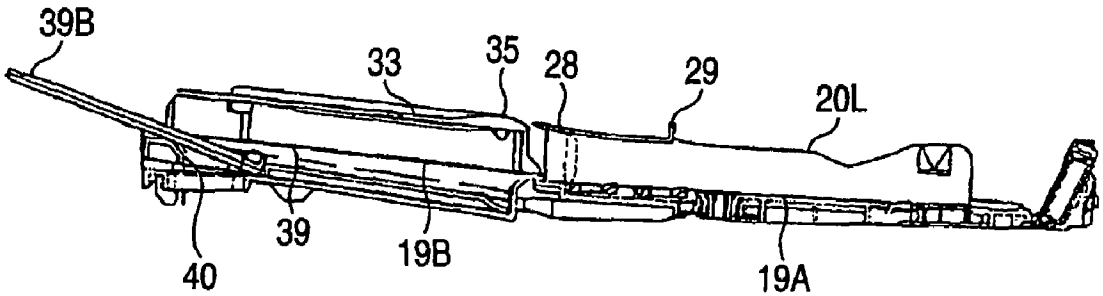

FIG. 13B shows a state that the auxiliary support member 39 is retracted and the extension tray 39B is extended by rotating it. In a case of accommodating B5-size sheets, for example, which are smaller than A4-size sheets, the sheets are entirely placed on the front loading surface 19B and the rear loading surface 19A, that is, no parts of the unrecorded sheets are placed on the auxiliary support member 39. In view of this, to allow the auxiliary support member 39 to support the extension tray 39B rotatably, first the auxiliary support member 39 is pulled out and the extension tray 39B is extended by rotating it and then the auxiliary support member 39 is retracted and accommodated in the support member accommodation hole 38. Even when small-size sheets are ejected, they can be prevented from hanging down and falling off because their leading edges can be supported by the extension tray 39B.

A guide plate 43 is attached to the rear end portion of the bottom plate 18 so as to extend over the entire width of the bottom plate 18. The front surface of the guide plate 43 is inclined upward. When the pick-up unit 16 (described later) pushes plural sheets placed on the bottom plate 18 to the guide plate 43, one of those sheets is separated and its leading edge is guided upward by the guide plate 43. The guide plate 43 is slightly curved so that its central portion in the width direction (right-left direction) bulges toward the front side, and a metal separation member 44 is attached to the guide plate 43 at the peak of the central bulge. The separation member 44 has plural teeth that are arranged at prescribed intervals in the vertical direction, and the tips of the respective teeth slightly project from the front surface of the guide plate 43. One of plural sheets pushed out by the pick-up unit 16 is separated as they touch the tips of the teeth. Further, the top portion of the central bulge of the guide plate 43 is provided with a pair of rotatable supply assistance rollers 45 on both sides, in the width direction, of the separation member 44.

The right-hand side end guide 20R is formed with a cam portion 60 for swinging a supply roller 52 and an arm member 53 when the supply tray 9 is pulled out of or inserted into the apparatus main body 3. The cam portion 60 is provided in such a manner that the height, as measured from the bottom surface of the bottom plate 18, of the top surface of a rear portion of the guide wall 22 of the side end guide 20R varies in the front-rear direction. As shown in FIGS. 6A-6E, the cam portion 60 is formed in such a manner that a slant surface 60A that goes down toward the rear side, a slant surface 60B that goes up toward the rear side, and a horizontal portion 60C whose height as measured from the bottom surface of the bottom plate 18 is almost constant are arranged continuously in this order toward the rear side. The horizontal portion 60C almost extends to the rear end of the guide wall 22, and is approximately at the same level in the vertical direction as the top of the guide plate 43.

Figure 5:
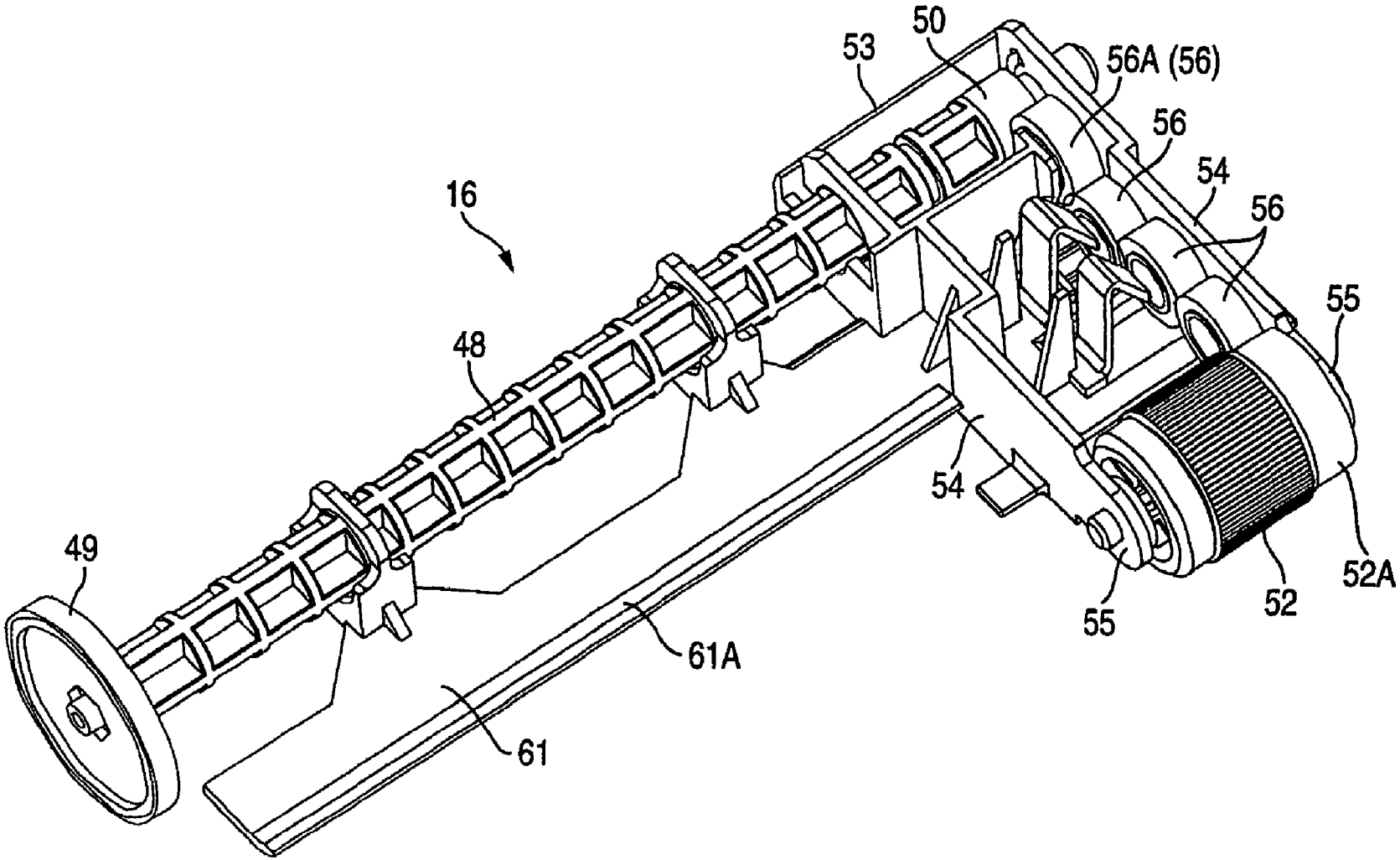
FIG. 5 is a perspective view of the pick-up unit.
Figure 6A:
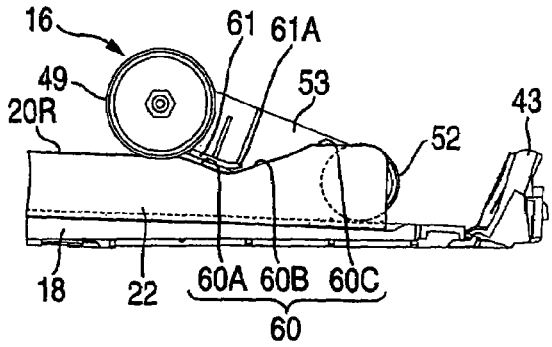
FIGS. 6A-6E are side views showing operations of the supply tray and the pick-up unit.
Figure 6B:
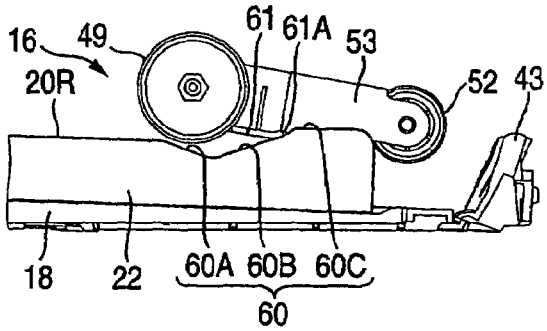
Figure 6C:
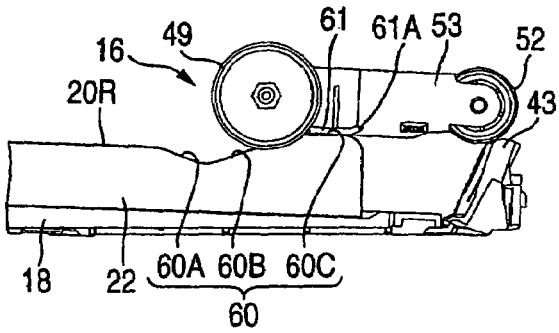
Figure 6D:
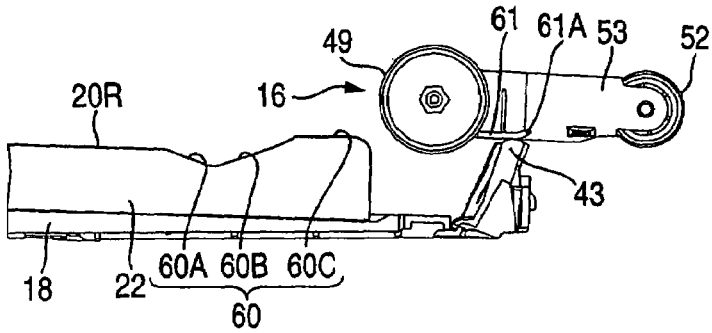
Figure 6E:
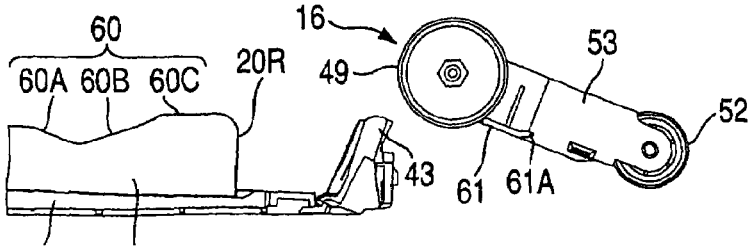

Next, the pick-up unit 16 for supplying sheets will be described with reference to FIGS. 2, 5, etc. FIG. 5 is a perspective view of the pick-up unit 16.

In the apparatus main body 3, a box-shaped frame 47 that is long in the right-left direction is disposed over a rear portion of the supply tray 9. A rotatable support shaft 48 extends in the frame 47 in the right-left direction (i.e., perpendicularly to the sheet supply direction), and the entire pick-up unit 16 is supported by the support shaft 48. The support shaft 48 extends so as to almost fully cover the range from the center to the right end of the supply tray 9 in the width direction. A large gear 49 is attached to the right-hand end of the support shaft 48 that is located outside the supply tray 9 in the width direction, more specifically, a little outside of the side end of the bottom plate 18. A small gear 50 having approximately the same diameter as the support shaft 48 is attached to the left-hand end of the support shaft 48.

An arm member 53 that supports the supply roller 52 is attached to an end portion of the support shaft 48 that is close to the center of the supply tray 9 in the width direction. The arm member 53 is provided with a pair of support arms 54 that extend outward in the radial direction from the support shaft 48 and are separated from each other in the right-left direction so as to be parallel with each other. The supply roller 52 is interposed between tip portions (swing end portions) of the two support arms 54 and the rotation shaft of the support roller 52 is supported by bearings 55 of the support arms 54, whereby the support roller 52 is held rotatable about the axis extending in the right-left direction. Four power transmission gears 56 ("power transmission mechanism" of the invention) that link the small gear 50 of the support shaft 48 and a gear portion 52A of the supply roller 52 are provided between the two support arms 54 so as to form a gear train extending along the support arms 54. When the support shaft 48 is rotated by the driving unit, the rotating power is transmitted to the supply roller 52 via the four power transmission gears 56. Among the four power transmission gears 56, the power transmission gear 56A that is directly engaged with the small gear 50 is what is called a one-way gear and is configured so as to transmit rotating power from the support shaft 48 side to the supply roller 52 side but not to transmit rotating power from the supply roller 52 side to the support shaft 48 side.

The arm member 53 can swing between a position where it assumes a rear-down posture that the rotation shaft of the supply roller 52 is lower than the support shaft 48 and a position where it assumes a horizontal posture that the rotation shaft of the supply roller 52 is approximately at the same level in the vertical direction as the center of the support shaft 48. When the arm member 53 assumes the horizontal posture, the arm member 53 and the supply roller 52 are almost fully accommodated in the frame 47. When the supply tray 9 on which plural sheets are placed is inserted in the tray accommodation portion 10 so as to be located at the regular attachment position, the swing end portion of the arm member 53 is lowered because of its own weight and the supply roller 52 is placed on the top sheet. If the supply roller 52 is rotated counterclockwise (as viewed in FIG. 2) in this state, sheets are pushed out rearward and their leading edges are pressed against the above-mentioned guide plate 43, whereby the one top sheet is separated and sent to the transport passage 15 side. A cork plate 57 having a large coefficient of friction against sheets is stuck to the rear loading surface 19A of the supply tray 9 at such a position as to be able to touch the supply roller 52 in a state that no sheets are placed thereon. This allows the supply roller 52 to easily send out the last one of sheets loaded on the supply tray 9.

The pick-up unit 16 is provided with a follower portion 61 for swinging the supply roller 52 and the arm portion 53 by cooperating with the cam portion 60 and the guide plate 43 when the supply tray 9 is pulled out of or inserted into the apparatus main body 3. The follower portion 61 extends from a bottom portion, close to the support shaft 48, of the right-hand support arm 54 of the arm member 53 along the support shaft 48 and is integral with the arm member 53. The follower portion 61 assumes, as a whole, a plate-like shape and is almost flush with the bottom surface of the support arm 54. In a state that the supply tray 9 is placed at the regular attachment position, the end of the follower portion 61 that is opposite to the arm member 53 is located around the side end of the supply tray 9. Therefore, the follower portion 61 is placed on the guide wall 2 whichever portion of the side end guide 20R the follower portion 61 corresponds to. A rear flange 61A of the follower portion 61 is bent upward by a small angle, and the distance from the center of the support shaft 48 to the rear flange 61A is a little shorter than a half of the distance from the center of the support shaft 48 to the rotation shaft of the supply roller 52. As described later in detail, when the supply tray 9 is pulled out or inserted, the bottom surface of the follower portion 61 is brought into sliding contact with the cam portion 60 or the guide plate 43 and the follower portion 61 is thereby displaced, whereby the arm member 53 is swung.

Figure 7:
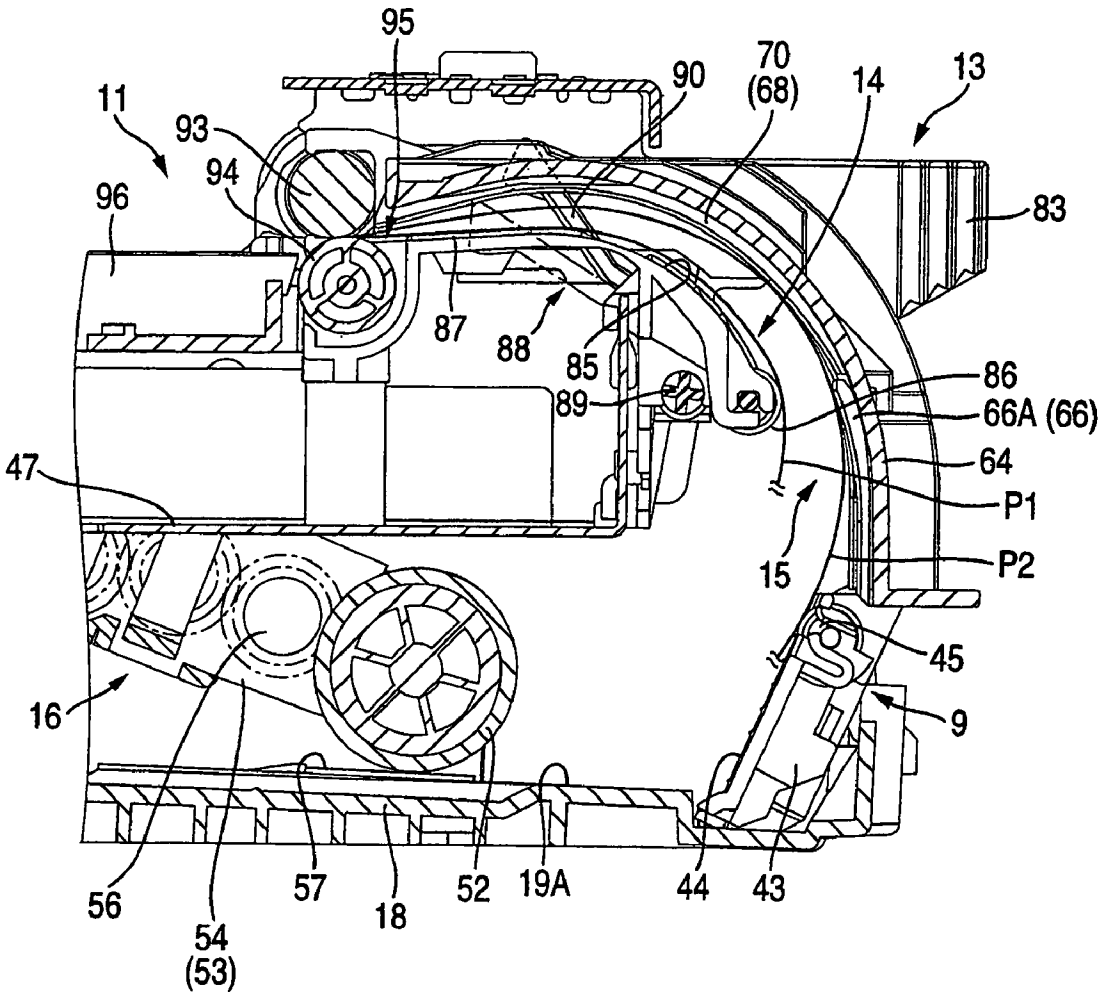
FIG. 7 is an enlarged sectional view of part of the image recording apparatus.
Figure 8:
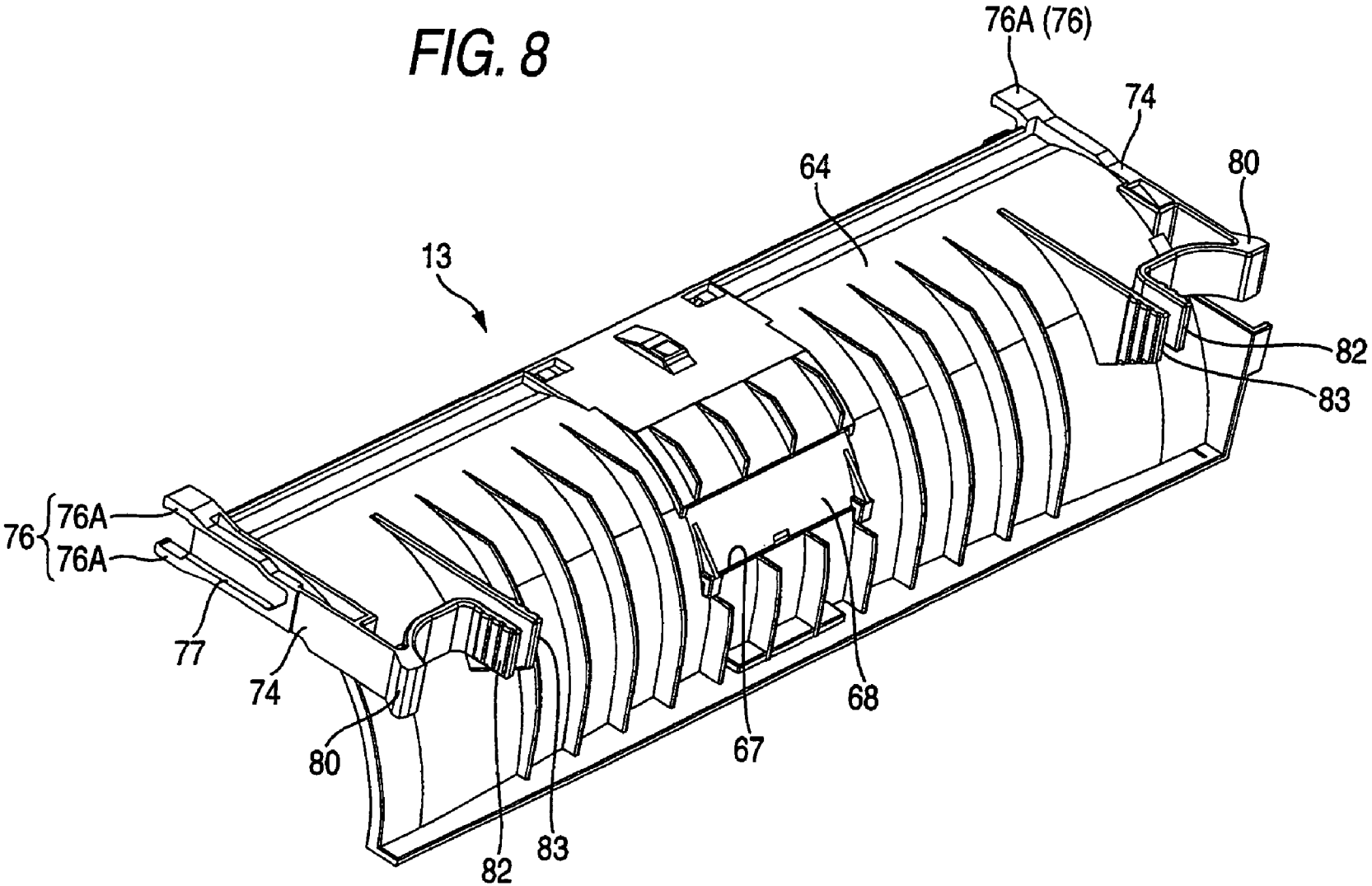
FIG. 8 is a rear perspective view of an outside arc-shaped guide.
Figure 9:
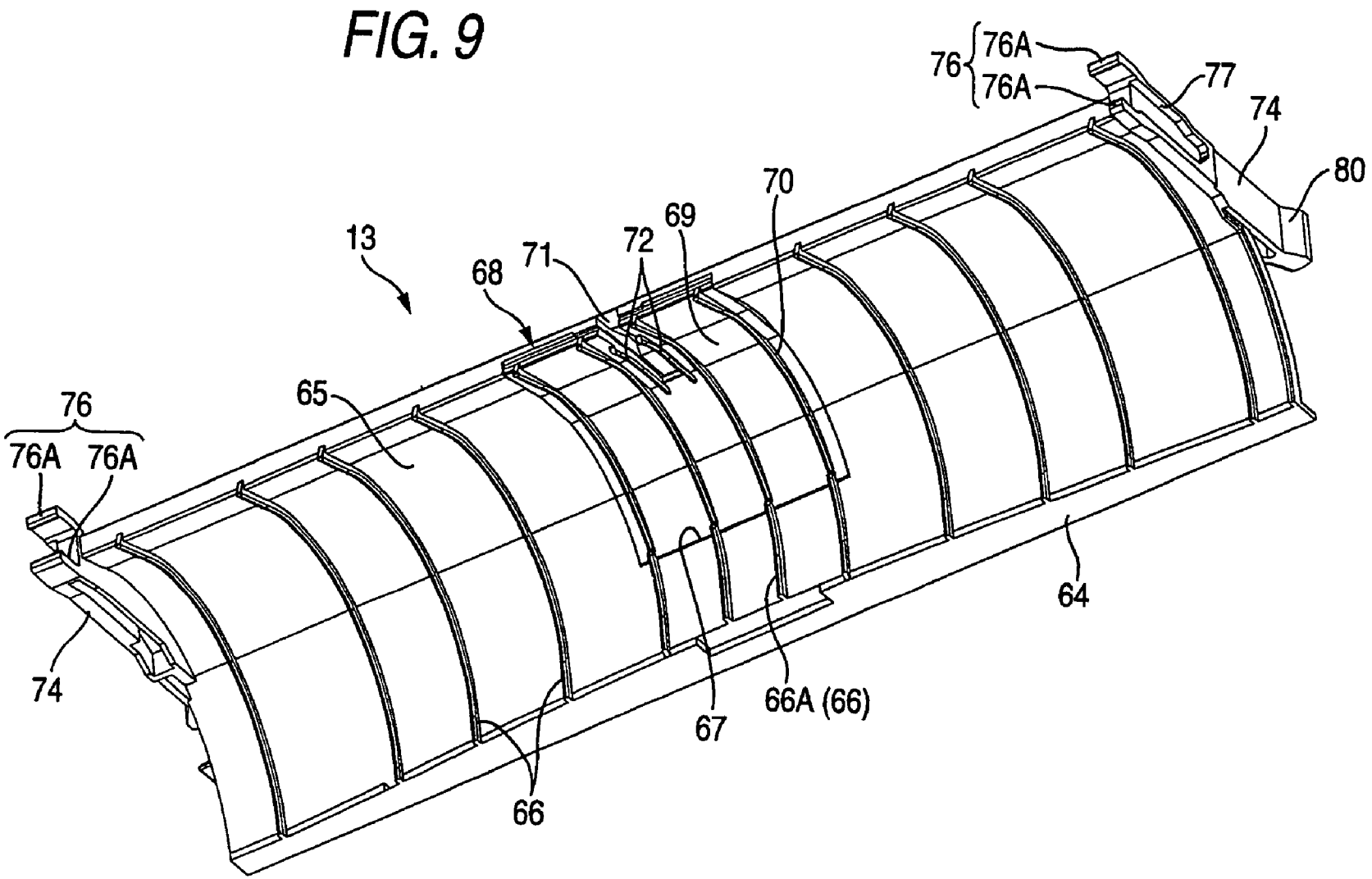
FIG. 9 is a front perspective view of the outside arc-shaped guide.
Figure 10:
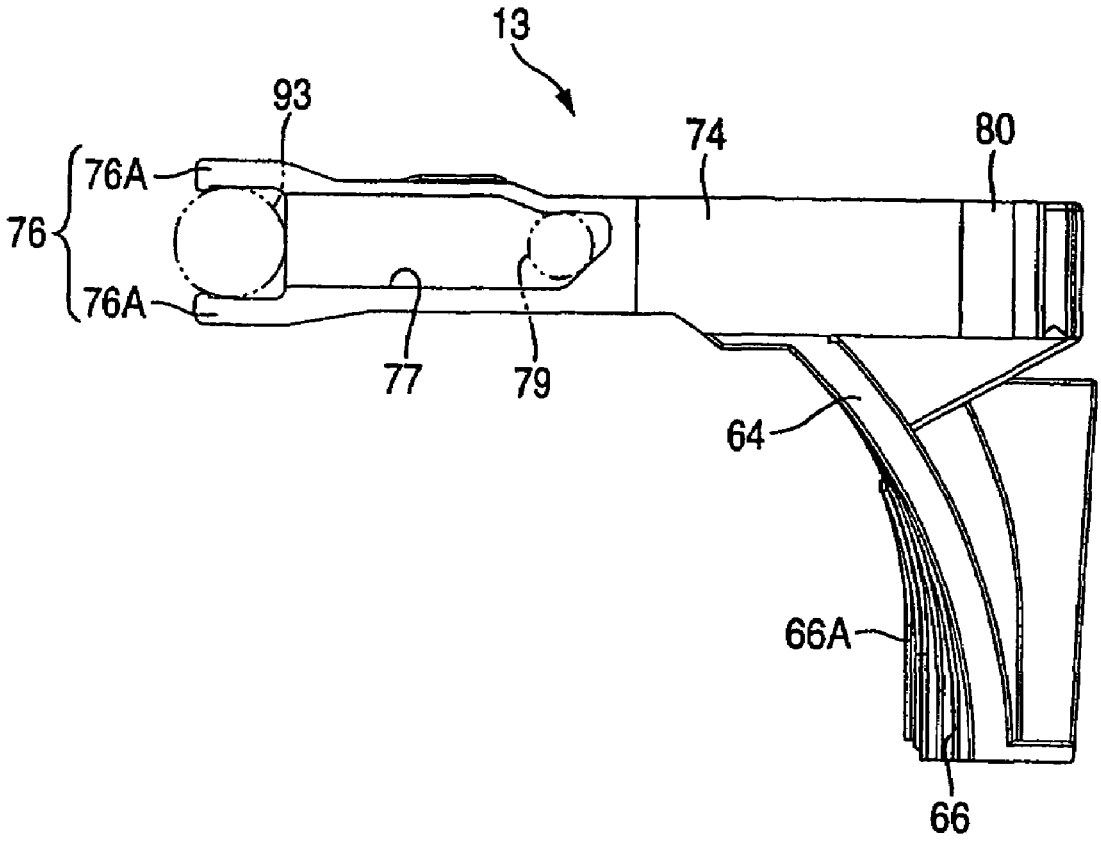
FIG. 10 is a side view of the outside arc-shaped guide.
Figure 11:
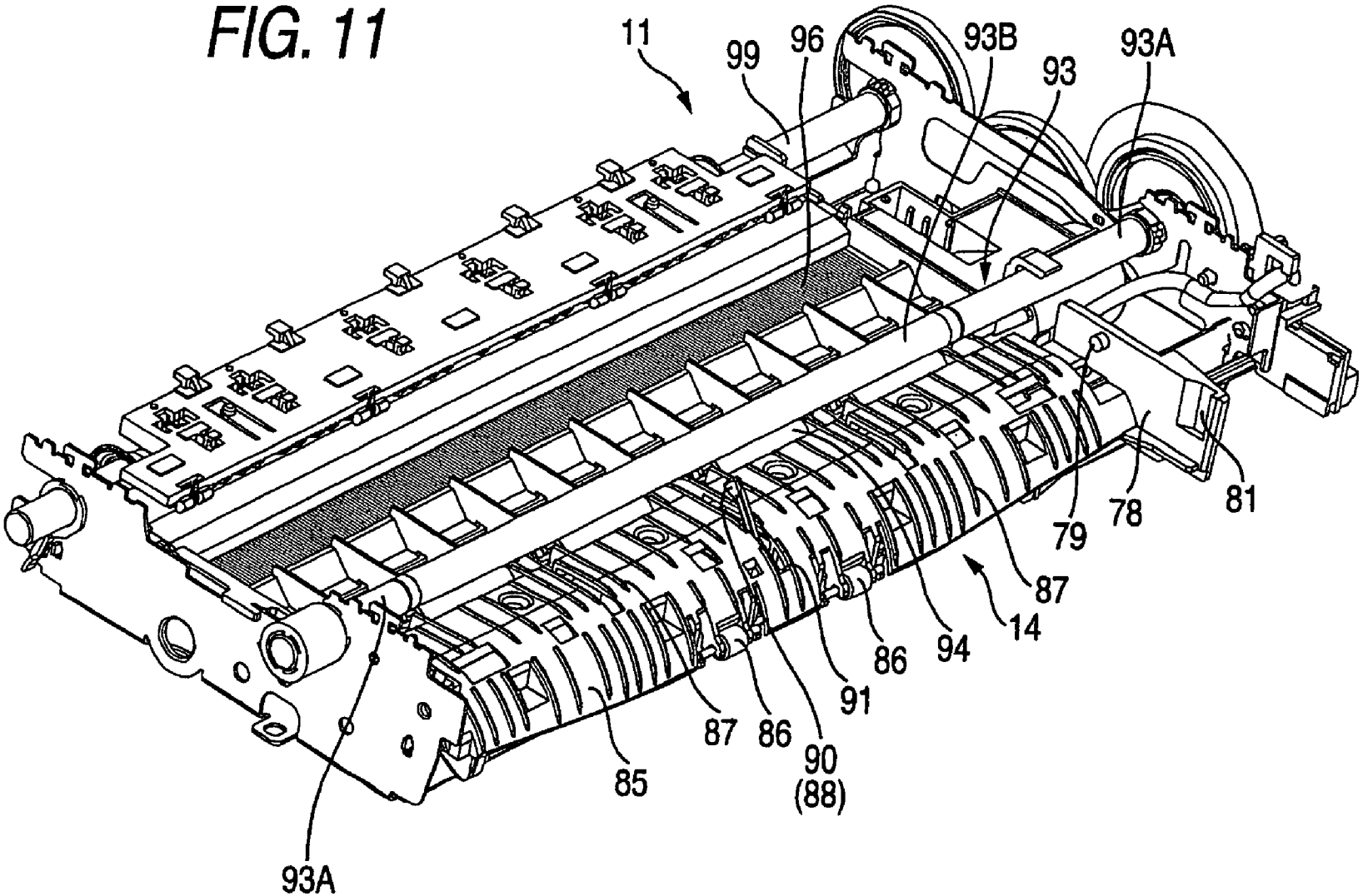
FIG. 11 is a perspective view of part of the image recording apparatus in a state that the outside arc-shaped guide is removed from it.
Figure 12:
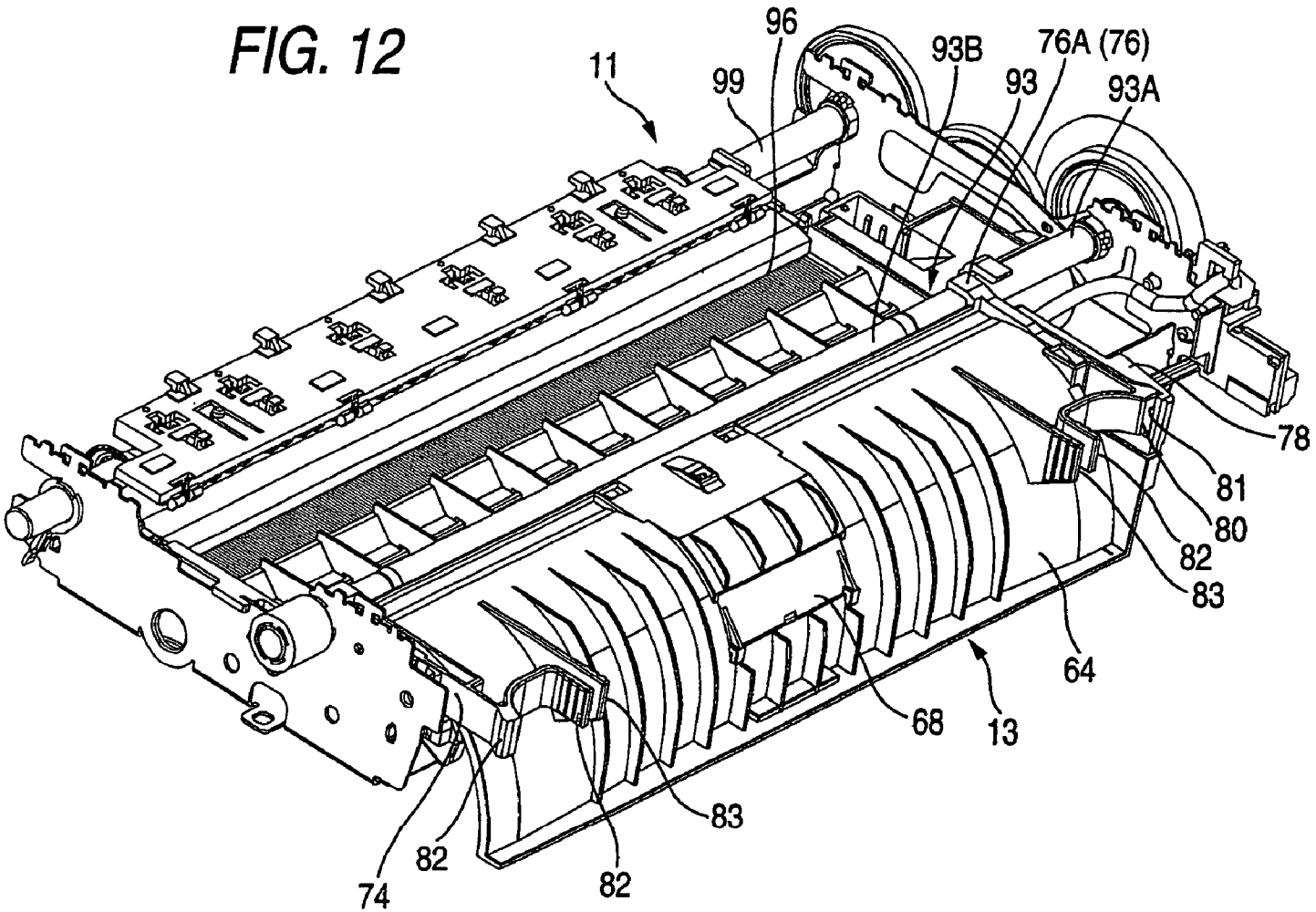
FIG. 12 is a perspective view of part of the image recording apparatus in a state that the outside arc-shaped guide is attached.

Next, the outside arc-shaped guide 13 will be described with reference to FIGS. 7-12. FIG. 7 is an enlarged sectional view of part of the image recording apparatus 1. FIG. 8 is a perspective view of the outside arc-shaped guide 13 as viewed perspectively from a top-rear position. FIG. 9 is a perspective view of the outside arc-shaped guide 13 as viewed perspectively from a bottom-front position. FIG. 10 is a side view of the outside arc-shaped guide 13. FIG. 11 is a perspective view of part of the image recording apparatus 1 in a state that the outside arc-shaped guide 13 is removed from it. FIG. 12 is a perspective view of part of the image recording apparatus 1 in a state that the outside arc-shaped guide 13 is attached.

The outside arc-shaped guide 13 is disposed behind the recording unit 11 and is attached to a top rear end portion of the supply tray 9. The outside arc-shaped guide 13 can be attached and detached through a guide attachment hole 63 that is formed in the rear wall of the casing 2 (also see FIG. 2). The outside arc-shaped guide 13 is entirely housed in the casing 2, and the rear surface of the outside arc-shaped guide 13 is approximately flush with that of the casing 2. The outside arc-shaped guide 13 has a main body 64 that is long in the width direction and is generally curved in arc form. The main body 64 has an outside guide surface 65 that faces the transport passage 15 and serves to guide a sheet. The outside guide surface 65 approximately coextends with the supply tray 9 in the right-left direction. The upstream end portion of the outside guide surface 65 is placed on the top portion of the guide plate 43, and the downstream end portion of the outside guide surface 65 is located immediately upstream of a registration roller 93 and follower rollers 94 that form a sheet insertion inlet 95 of the recording unit 11 (described later). The upstream end portion of the outside guide surface 65 is approximately vertical. As the position further goes downstream to reach the downstream end, the outside guide surface 65 is inclined forward gradually, becomes horizontal, and then goes down. A downstream end portion of the outside guide surface 65 is a flat surface. Plural ribs 66 project from the outside guide surface 65 so as to be parallel with the sheet transport direction and to be arranged in the width direction at prescribed intervals. A central portion, in the width direction, of a upstream end portion of the outside guide surface 65 bulges into the transport passage 15, and hence central ribs 66A project more into the transport passage 15 than the other ribs 66 do.

The main body 64 is formed with a fixing recess 67 at the center in the width direction downstream of the bulge of the outer guide surface 65, and a curved, plate-like resistance reducing portion 68 is fixed to the fixing recess 67. The entire outside arc-shaped guide 13 including the main body 64 and the resistance reducing portion 68 are made of synthetic resins, and the resistance reducing portion 68 is made of a synthetic resin that is lower in frictional resistance than a synthetic resin of which the other parts of the outside arc-shaped guide 13 are made. More specifically, the resistance reducing portion 68 is made of a polyacetal resin (POM), for example, and the other parts are made of polystyrene resin (PS), for example. The resistance reducing portion 68 has a guide surface 69 having approximately the same shape as the outside guide surface 65 of the main body 64, and plural ribs 70 project from the guide surface 69 so as to be continuous with the corresponding ribs 66A of the above-mentioned bulge of the main body 64 and to be parallel with the sheet transport direction. Upstream end portions of the ribs 70 of the resistance reducing portion 68 project a little less than top portions of the ribs 66A of the main body 64. This prevents an event that the bottom ends of the ribs 70 of the resistance reducing portion 68 project more than the ribs 66A of the main body 64 due to molding errors, for example, as a result of which the leading edge of a sheet that is sent from below is caught on the ribs 70 of the resistance reducing portion 68. The guide surface 69 of the resistance reducing portion 68 is formed with, close to its downstream end at the center in the width direction, a sensing piece accepting hole (recess) 71 capable of accepting the tip of a sensing piece 90 of a registration sensor 88 (described later). The sensing piece accepting hole 71 is long in the sheet transport direction, and sensing assistance ribs 72 projecting by approximately the same length as the ribs 70 are formed at the edges of the sensing piece accepting hole 71 on both sides in the width direction.

Side plate portions 74 extend in the front-rear direction from the two top side end portions of the main body 64. The front ends of the side plate portions 74 are located at approximately the same position in the front-rear direction as the downstream end of the outside guide plate 65, and a positioning engagement portion 76 having a pair of engagement nails 76A arranged in the vertical direction projects forward from the front end of each side plate portion 74. The pair of engagement nails 76A of the positioning engagement portion 76 can be fitted with shaft support portions 93A of the registration roller 93 (described later).

The outer side surface of each side plate portion 74 is formed with a guide groove 77 that extends rearward from between the engagement nails 76A of the positioning engagement portion 76. On the other hand, the apparatus main body 3 is formed with a pair of side walls 78 on both sides of the outside arc-shaped guide 13 (see FIG. 11; the side wall 78 on the viewer's side is omitted in FIG. 11 and the two side walls 78 are generally symmetrical in shape), and each side wall 78 has a guide projection 79 that can be engaged with the associated guide groove 77. The guide projections 79 and the guide grooves 77 have a function of guiding the outside arc-shaped guide 13 to the regular attachment position in attaching the outside arc-shaped guide 13 to the apparatus main body 3. The width of each guide groove excluding its rear end portion is somewhat greater than the diameter of the guide projection 79, and the rear end portion is made narrower so as to be fitted with the guide projection 79 tightly.

Lock portions 80 extend rearward from the rear ends of the respective side plate portions 74. The lock portions 80 are capable of flexural deformation in the right-left direction and their tip portions project outward. When the tip portions are engaged with lock subject portions (recesses) 81 of the side walls 78, respectively, the outside arc-shaped guide 13 is locked at the regular attachment position. A release manipulation portion 82 extends inward in the width direction of the outside arc-shaped guide 13 from the front end of each lock portion 80 so as to be curved like a bracket shape. The lock portions 80 can be displaced so as to be disengaged from the lock subject portions 81 by manipulating the release manipulation portions 82. A pair of, that is, right and left, plate-like grips 83 project from the rear surface of the main body 64 so as to be opposed to the tip portions of the release manipulation portions 82, respectively, with a prescribed interval formed in between. The outside arc-shaped guide 13 can be attached or detached by simultaneously holding the release manipulation portions 82 and the grips 83.

The inside arc-shaped guide 14 is attached to the apparatus main body 3 so as to be spaced from the outside arc-shaped guide 13 and has an inside guide surface 85 that is opposed to the outside arc-shaped guide 13. An upstream portion (rear portion) of the inside guide surface 85 is a convex (arc-shaped) surface that is larger in curvature than the outside guide surface 65 of the outside arc-shaped guide 13, and a downstream portion (front portion) is an approximately horizontal, flat surface. The upstream end (i.e., the bottom) of the inside guide surface 85 is located above that of the outside guide surface 65, and is provided with a pair of, that is, right and left, rotatable supply assistance rollers 86 close to the center in the width direction. Plural ribs 87 project from the inside guide surface 85 so as to be parallel with the sheet transport direction and to be arranged in the width direction at prescribed intervals. Each rib 87 is separated into front and rear ribs.

As described above, the U-shaped transport passage 15 is formed between the inside guide surface 85 of the inside arc-shaped guide 14 and the outside guide surface 65 of the outside arc-shaped guide 13. The interval between the guide surfaces 65 and 85 of the two arc-shaped guides 13 and 14 is longest approximately at the upstream end (i.e., the input opening of the transport passage 15) and decreases gradually as the position goes downstream. The interval between the guide surfaces 65 and 85 is sufficiently longer than the thickness of a sheet except near the downstream end. This allows a sheet to be displaced in its thickness direction in the transport passage 15. In the vicinity of the downstream end, the interval between the guide surfaces 65 and 85, more strictly, the interval between the tips of the ribs 66 and 87 of the two guide surfaces 65 and 85, is relatively short, which allows the leading edge of a sheet as output from the transport passage 15 to be positioned correctly with respect to the sheet insertion inlet 95 that is formed by the registration roller 93 and the follower rollers 94. As described above, no means (e.g., pinch rollers) for transporting a sheet while pinching it are provided in the transport path between the supply roller 52 and the registration roller 93.

A registration sensor 88 for detecting the leading edge and the trailing edge of a sheet is provided under the inside arc-shaped guide 14 (i.e., on the side of its surface opposite to the inside guide surface 85) at the center in the width direction. The registration sensor 88 has the sensing piece 90 that can rotate about a fixing shaft 89 extending in the right-left direction, and the sensing piece 90 is urged clockwise in FIG. 7 by a spring member (not shown). A through-hole 91 is formed through the inside arc-shaped guide 14 at the center in the width direction, and a tip portion of the sensing piece 90 projects through the through-hole 91 into the transport passage 15. If the tip portion of the sensing piece 90 does not interfere with a sheet in the transport passage 15, it is accepted by the sensing piece accepting hole 71 of the outside arc-shaped guide 13 (this position of the sensing piece 90 is called "non-interference position"; indicated by solid lines in FIG. 7). If the tip portion of the sensing piece 90 interferes with a sheet, the sensing piece 90 escapes downward (this position of the sensing piece 90 is called "interference position"; indicated by a two-dot chain line in FIG. 7). The registration sensor 88 has a photointerrupter (not shown) for detecting the position of the sensing piece 90.

Next, the recording unit 11 will be described with reference to FIGS. 2, 7, 11, etc. The registration roller 93 is provided at the upstream end (rear end) of the recording unit 11 so as to extend in the right-left direction. The shaft support portion 93A that are fixed to the apparatus main body 3 are provided at both ends of the registration roller 93, and a rotation portion 93B that can be rotated by motive power supplied from a driving means is provided between the two shaft support portions 93A. The plural follower rollers 94 that can rotate following the registration roller 93 are disposed under the rotation portion 93B of the registration roller 93. The sheet insertion inlet 95 is formed between the registration roller 93 and the follower rollers 94. The downstream end of the above-mentioned transport passage 15 is connected to the sheet insertion inlet 95.

In the recording unit 11, a platen 96 for supporting a sheet from below is disposed downstream of (on the front side of) the follower rollers 94. A carriage 98 that is mounted with a recording head 97 occupies a top portion of the recording unit 11. The recording head 97 ejects ink onto a sheet on the platen 96 while the carriage 98 is moved over the platen 96 in the right-left direction, whereby an image is recorded. The ejection roller 99 extending in the right-left direction is disposed downstream of the platen 96. The ejection roller 99 is rotationally driven in synchronism with the registration roller 93 and thereby ejects, to the above-mentioned supply tray 9, a sheet on which an image has been recorded by the recording head 97.

The configuration of the embodiment has been described above, and its workings will be described below.

To load sheets onto the supply tray 9 that is accommodated in the apparatus main body 3, first, the supply tray 9 is pulled forward out of the tray accommodation portion 10. In this case, the supply tray 9 can easily be pulled out by pulling it to the front side by inserting fingers into the finger hook hole 40 of the auxiliary support member 39 accommodated in the support member accommodation hole 38 and the second finger hook hole 41 of the bottom plate 18.

To pull out the supply tray 9 that is loaded with sheets, it is necessary to pull out the sheets with the supply roller 52 placed thereon. If the rear loading surface 19A of the supply tray 9 were a horizontal surface, the sheets might be caught by the supply roller 52 in pulling out the supply tray 9. In contrast, in the embodiment, since the rear loading surface 19A of the supply tray 9 is inclined in such a manner that its downstream side in the sheet supply direction (i.e., rear side) is lower, in pulling out the supply tray 9 the sheets can be pulled out so as to be separated from (located under) the supply roller 52 that has so far been placed on the sheets. Therefore, the sheets are not prone to be caught by the supply roller 52 and hence the supply tray 9 can be pulled out smoothly.

Next, description will be made of how the pick-up unit 16 operates when the supply tray 9 is pulled out. When the supply tray 9 is located at the regular attachment position, the supply roller 52 is in contact with the top surface of sheets or the rear loading surface 19A of the bottom plate 18 and the follower portion 61 is separated from (located over) the slant surface 60A of the cam portion 60 (see FIG. 6A). When the supply tray 9 is pulled forward starting from this state, the rear flange 61A of the follower portion 61 comes into contact with the slant surface 60B of the cam portion 60 and then goes up while being kept in sliding contact with the slant surface 60B, whereby the arm member 53 is swung counterclockwise in the figure and the supply roller 52 is lifted up (see FIG. 6B). When the supply tray 9 is further pulled forward, the rear flange 61A of the follower portion 61 passes the slant surface 60B of the cam portion 60 and runs up onto the top surface of the horizontal portion 60C, whereby the arm member 53 comes to assume a horizontal posture (see FIG. 6C). Then, the supply roller 52 hits the top portion of the guide plate 43, and climbs over the guide plate 43 while rotating because of friction with the guide plate 43. After the supply roller 52 has climbed over the guide plate 43, the top portion of the guide plate 43 comes into contact with the bottom surface of the arm member 53 and is moved toward the support shaft 48 while being kept in contact with the arm member 53 (see FIG. 6D). After the top portion of the guide plate 43 is further moved forward and is separated from the bottom surface of the arm member 53, the supply roller 52 descends because of its own weight (see FIG. 6E).

As described above, since the side end guide 20R is formed with the cam portion 60 for lifting up the supply roller 52 in attaching or detaching the supply tray 9, a side wall of the supply tray 9 can be omitted and the width of the supply tray 9 can be reduced accordingly. The apparatus 1 can thus be miniaturized.

The supply tray 9 is easy to hold with hands because it is provided with not only the side end guides 20R and 20L which can be displaced but also the fixed side walls 32 that are located on the front side of the side end guides 20R and 20L. Further, located at such positions as to be approximately flush with the respective side end guides 20R and 20L, the fixed side walls 32 do not increase the width of the supply tray 9.

After the supply tray 9 is removed from the apparatus main body 3 in the above-described manner, sheets to be used are stacked on the loading surfaces 19A and 19B. Where sheets of the A4 size, B5 size, or the like are to be used, the sheets are inserted from the front side of the supply tray 9 so as to go under the cover 33 and reach a position where they touch the guide plate 43 that is located far back. In this operation, even sheets smaller than the A4-size (e.g., B5-size sheets) can be inserted deep into the supply tray 9 because the cover 33 is formed with the cut 36. Where sheets smaller than the B5 size (e.g., postcard-size sheets or L-size sheets) are to be used, the corresponding positioning rib 31 is erected and the sheets are placed between that positioning rib 31 and the guide plate 43.

Then, if the two side ends of sheets are not in contact with the guide walls 22, the positions of the two side end guides 20R and 20L are adjusted in the right-left direction to bring the guide walls 22 into contact with the sheets. In this operation, when the right-hand side end guide 20R is displaced in the width direction, the left-hand side end guide 20L is moved together with it: the efficiency of the positioning work is thus high. When the two guide walls 22 have been brought into contact with both ends of the sheets, the sheets are centered in the width direction in the supply tray 9.

Then, the supply tray 9 loaded with the sheets is inserted into the apparatus main body 3. When the supply tray 9 is inserted horizontally from the front side of the apparatus main body 3 into the tray accommodation portion 10, first the top portion of the guide plate 43 comes into contact with the follower portion 61 and the arm member 53. The follower portion 61 and the arm member 53 climb over the guide plate 43 and the supply roller 52 is lifted up. The arm member 53 is swung until it assumes an approximately horizontal posture (see FIG. 6D). When the supply tray 9 is pushed further deep into the apparatus main body 3, the follower portion 61 is placed on the horizontal portion 60C of the cam portion 60. Then, the supply roller 52 hits the top portion of the guide plate 43 and climbs over the guide plate 43 (see FIG. 6C). Then, the rear flange 61A of the follower portion 61 goes down the slant surface 60B of the cam portion 60 and the supply roller 52 descends (see FIG. 6B). The supply roller 52 comes into contact with the top surface of the sheets that are placed on the loading surfaces 19A and 19B, and the follower portion 61 is separated from (located over) the cam portion 60. Since the rear loading surface 19A of the supply tray 9 is inclined in such a manner that its downstream side in the sheet supply direction (i.e., its rear side) is lower, the sheets are inserted under the supply roller 52 so as to push up it from below. Therefore, the sheets are less prone to be caught by the supply roller 52 than in the case that the sheet loading surface is horizontal, and hence positional deviation of the sheets can be prevented. The attachment of the supply tray 9 is finished when the supply tray 9 has been inserted to the regular attachment position (see FIG. 6A).

Next, an operation that is performed in recording an image on a sheet will be described.

First, the large gear 49 is rotationally driven by motive power supplied from the driving unit and its rotating power is transmitted to the supply roller 52 via the power transmission gears 56. As a result, the supply roller 52 is rotated counterclockwise in FIG. 7 and sheets on the loading surfaces 19A and 19B are thereby pushed out rearward and pressed against the guide plate 43. Since the central portion of the guide plate 43 bulges forward, the leading edges of the sheets being pressed against the guide plate 43 are guided upward while assuming a curved posture together that the central portion is somewhat higher than the other portions. The central portions of the leading edges of the sheets hit the teeth of the separation member 44 that is provided at the end of the bulge of the guide plate 43, whereby the top sheet is separated. The sheet thus guided upward is sent to the transport passage 15 located above while being kept in contact with the supply assistance rollers 45 which are provided at the top of the guide plate 43 on both sides of the separation member 44 in the width direction.

The sheet that has been sent out upward from the guide plate 43 hits a portion, close to the upstream end, of the outside guide surface 65 of the outside arc-shaped guide 13. At this time, since in the portion close to the upstream end of the outside arc-shaped guide 13, the central (in the width direction) ribs 66A of the plural ribs 66 project more into the transport passage 15, the central portion in the width direction of the leading edge of the sheet that is given a curved posture by the guide plate 43 comes into contact with the ribs 66A and both end portions in the width direction escape rearward. This prevents the central portion in the width direction of the sheet from being separated from the guide plate 43 due to the contact of leading edge portion of the sheet with the outside arc-shaped guide 13, and the contact between the sheet and the supply assistance roller 45 can be maintained.

In this manner, the sheet that has been put into the transport passage 15 is guided upward while its leading edge is mainly kept in contact with the central ribs 66A of the outside guide surface 65. Then, the central portion of the leading edge of the sheet comes into contact with the ribs 70 of the resistance reducing portion 68. The central portion of leading edge of the sheet is guided downward while being kept in sliding contact with the ribs 70 of the resistance reducing portion 68, and both end portions in the width direction of the sheet come into sliding contact with the ribs 66 of the outside guide surface 65. The posture of the leading edge of the sheet is corrected gradually to become flat as it is guided forward.

As described above, since the resistance reducing portion 68 exhibiting low frictional resistance to a sheet is provided at the center, in the width direction of the outside arc-shaped guide 13, a sheet can be guided downstream smoothly without being caught in the transport path. If the entire outside arc-shaped guide were made of a resin that exhibits low frictional resistance to a sheet, it might be difficult to attain high molding accuracy or the cost might increase. In contrast, in the embodiment, only the central portion that receives high contact pressure from a sheet is a resin member that exhibits low contact resistance, whereby reduction in molding accuracy and cost increase can be avoided while the frictional resistance to a sheet is reduced.

When the leading edge of the sheet hits the sensing piece 90 of the registration sensor 88 that projects into the transport passage 15, the sensing piece 90 is pushed downward by the sheet to the interference position (indicated by the two-dot chain line in FIG. 7), whereby it is detected that the leading edge of the sheet has reached the position of the sensing piece 90. Since the sensing assistance ribs 72 project at the edges of the sensing piece accepting hole 71 on both sides in the width direction, the sheet that is pressed by the urging force of the sensing piece 90 is supported by the pair of sensing assistance ribs 72 from the side opposite to the sensing piece 90. Therefore, the sheet is prevented from being dented into the sensing piece accepting hole 71. This makes it possible to secure a sufficient displacement of the sensing piece 90 between the interference position and the non-interference position and hence to increase the correctness of detection of a sheet.

The leading edge of the sheet that has passed the position of contact with the sensing piece 90 goes out of the transport passage 15 and reaches the sheet insertion inlet 95 between the registration roller 93 and the follower roller 94. The leading edge of the sheet is directed correctly to the sheet insertion inlet 95 because the portion, close to the downstream end, of the outside guide surface 65 of the outside arc-shaped guide 13 is a flat surface.

The registration roller 93 is controlled so as to start to be rotationally driven in the reverse direction (counterclockwise in FIG. 7) when the registration sensor 88 detects the leading edge of the sheet and then start to be rotationally driven in the normal direction (clockwise in FIG. 7) after a lapse of a prescribed time. Since the registration roller 93 is being rotated in the reverse direction when the leading edge of the sheet has reached the sheet insertion inlet 95 between the rollers 93 and 94, the leading edge cannot be inserted between the rollers 93 and 94. The inclination of the sheet is corrected during this course.

After the registration roller 93 starts to be rotated in the normal direction with the prescribed timing, the leading edge of the sheet is nipped by the rollers 93 and 94 and sheet is pulled forward. Where the sheet is made of a material that is relatively high in flexibility (e.g., a thin printing sheet or an OHP sheet), when the leading edge of the sheet is pulled forward, the sheet that has been in a posture that it extends along (is in contact with) the ribs 66 and 70 of the outside arc-shaped guide 13 is displaced toward the inside arc-shaped guide 14 and comes to extend along the inside guide surface 85 (e.g., as indicated by symbol P1 in FIG. 7). The registration roller 93 starts to be rotated in this state, and the sheet P1 is sent downstream by the supply assistance rollers 86 and pulled into the sheet insertion inlet 95 while being kept in sliding contact with the ribs 87 of the inside guide surface 85.

Where the sheet is made of a material that is relatively low in flexibility (e.g., a thick sheet or a postcard), when the leading edge of the sheet is pulled forward by the registration roller 93, the sheet is displaced toward the inside arc-shaped guide 14 but does not assume a posture that it extends along (is in contact with) the inside guide surface 85. Instead, the sheet is displaced to a position that is closer to the outside arc-shaped guide 13 than in the above-described case of the sheet P1 (e.g., as indicated by symbol P2 in FIG. 7). That is, the sheet P2 that is low in flexibility comes to assume a posture having a smaller curvature in the transport passage 15 than the sheet P1 that is high in flexibility does. The registration roller 93 starts to be rotated in this state, and the sheet P2 is pulled into the sheet insertion inlet 95 while assuming a free posture in the transport passage 15 depending on various conditions such as the pull from the registration roller 93 and the degree of flexibility of the sheet P2.

If the apparatus were configured so that a sheet is transported while always assuming a fixed posture (having the same curvature) in the transport path, the sheet might be bent forcibly to impose an undue load on the transport unit such as the registration roller or the supply roller depending on the material of the sheet when the sheet receives a pull or push from the transport unit. In contrast, in the embodiment, since the transport passage 15 that allows a sheet to be displaced in its thickness direction is provided between the outside arc-shaped guide 13 and the inside arc-shaped guide 14, the posture of a sheet is given a certain degree of freedom and hence the load on the transport unit can be reduced. Smooth transport is enabled without the need for using pinch rollers or the like. As a result, the apparatus can be simplified in structure, miniaturized, and reduced in cost.

When the sheet that has passed the sheet insertion inlet 95 is sent onto the platen 96 by the rotation of the registration roller 93, a prescribed image is recorded on the sheet placed on the platen 96 by the recording head 97. The sheet that has passed the platen 96 is transported forward by the ejection roller 99 and ejected to the top surfaces of the overhangs 28 and the cover 33 of the supply tray 9. Since the supply tray 9 also serves as the ejection tray for receiving sheets that are ejected from the recording unit 11, the apparatus is compact as a whole. Further, since the cover 33 and the overhangs 28 are inclined in such a manner that their rear sides are lower, sheets placed on their top surfaces are prevented from falling off forward.

To record an image on a sheet such as an A4-size sheet that is longer than the length of the cover 33 and the overhangs 28 combined, the auxiliary support member 39 is pulled out forward in advance. With this measure, end portions of sheets that hang down from the front end of the cover 33 can be supported by the auxiliary support member 39 and hence the sheets are prevented from falling off forward. While not in use, the auxiliary support member 39 is accommodated in the support member accommodation hole 38 and hence does not become an obstruction.

Where ejected sheets are small enough not to project from the front end of the cover 33, the sheets can easily be taken out by pinching their end portions from above and below through the cut 36 of the cover 33 without the need for pulling out the supply tray 9 from the apparatus main body 3.

Next, description will be made of a procedure for detaching the outside arc-shaped guide 13 from the apparatus main body 3 and then attaching the former to the latter in jam clearing or the like. To remove the outside arc-shaped guide 13, first, an operator simultaneously holds the right and left release manipulation portions 82 and the grips 83 connected to or extending from the outer surface (rear surface) of the outside arc-shaped guide 13 with his or her fingers through the guide attachment hole 63 and pushes the release manipulation portions 82 toward the respective grips 83. As a result, the lock portions 80 are bent inward in the width direction and disengaged from the respective lock subject portions 81. The operator pulls the outside arc-shaped guide 13 rearward while continuing to hold the release manipulation portions 82 and the grips 83. As a result, the positioning engagement portions 76 are disengaged from the respective shaft support portions 93A of the registration roller 93. The operator further pulls the outside arc-shaped guide 13, whereby the guide projections 79 go out of the respective guide grooves 77. The outside arc-shaped guide 13 can thus be taken out. When the outside arc-shaped guide 13 has been removed from the apparatus main body 3, the transport passage 15 is opened on the one side. Since no members (e.g., pinch rollers) for pinching a sheet are provided in the transport passage 15, work of removing a jammed sheet can be performed easily.

To attach the removed outside arc-shaped guide 13 to the apparatus main body 3 again, the operator holds the right and left release manipulation portions 82 and the grips 83 simultaneously with his or her fingers and inserts the outside arc-shaped guide 13 through the guide attachment hole 63 from the rear side while pushing the release manipulation portions 82 toward the respective grips 83. As a result, the guide projections 79 are engaged with the respective guide grooves 77 and the outside arc-shaped guide 13 is thereby guided. This prevents inclination of the outside arc-shaped guide 13. When the outside arc-shaped guide 13 has come close to its regular attachment position, each shaft support portion 93A of the registration roller 93 goes into the space between the two engagement nails 76A of the associated positioning engagement portion 76 while causing small outward flexural deformation in the engagement nails 76A and the shaft support portions 93A are fitted into the respective positioning engagement portion 76. When the operator releases his or her fingers from the release manipulation portions 82 and the grips 83, recovery deformation occurs in the release manipulation portions 82, whereby the lock portions 80 are engaged with the respective lock subject portions 81 and the outside arc-shaped guide 13 is locked at its regular attachment position.

Simultaneously holding the release manipulation portions 82 and the grips 83 as described above makes it possible to simultaneously effect a manipulation of engaging or disengaging the lock portions 80 and a manipulation of attaching or detaching the outside arc-shaped guide 13. This provides increased work efficiency.

Further, since the positioning engagement portions 76 of the outside arc-shaped guide 13 can be fitted with the rotation shaft of the registration roller 93, the accuracy of positioning of the outside arc-shaped guide 13 with respect to the registration roller 93 can be increased. Therefore, the leading edge of a sheet can be guided correctly to the position where it is to be nipped by the registration roller 93 and the follower roller 94.

As described above, in the embodiment, the side end guide 20R is formed with the cam portion 60 (swinging means) for lifting up the supply roller 52 in pulling out or inserting the supply tray 9. This makes it possible to omit side walls of the supply tray 9 and to miniaturize the apparatus by reducing the width of the supply tray 9 accordingly.

To pull out the supply tray that is loaded with sheets, it is necessary to pull out the sheets with the supply roller placed thereon. If the loading surface of the supply tray were a horizontal surface, the sheets might be caught on the supply roller in pulling out the supply tray. In contrast, in the embodiment, since the rear loading surface 19A of the supply tray 9 is inclined in such a manner that its downstream side in the sheet supply direction (i.e., rear side) is lower, in pulling out the supply tray 9 the sheets can be pulled out so as to be separated from (located under) the supply roller 52 that has so far been placed on the sheets. Therefore, the sheets are not prone to be caught on the supply roller 52 and hence the supply tray 9 can be pulled out smoothly.

The arm member 53 is provided with the pair of support arms 54 that support the supply roller 52, and the power transmission gears 56 for transmitting drive power from the support shaft 48 to the supply roller 52 are provided between the support arms 54. This makes the structure of the arm member 53 compact.

The two side end guides 20R and 20L are moved together via the linear guide bars 23 and the pinion gear 26. This increases the efficiency of positioning work.

Since the guide plate 43 serves as a rear end wall of the supply tray 9, a sheet that has been pushed out by the supply roller 52 is supplied to the recording unit 11 after its leading edge is guided upward by the guide plate 43.

Since the central bulge of the guide plate 43 is provided with the separation member 44, sheets hitting the separation member 44 are separated from each other reliably.

Since the supply assistance rollers 45 are provided on both sides of the separation member 44, a sheet that has been separated by the separation member 44 can be transported smoothly while being kept in contact with the supply assistance rollers 45.

The supply tray 9 is easy to hold with hands because it is provided with not only the side end guides 20R and 20L which can be displaced but also the fixed side walls 32 that are located on the front side of the side end guides 20R and 20L. Further, located at such positions as to be approximately flush with the respective side end guides 20R and 20L, the fixed side walls 32 do not increase the width of the supply tray 9.

Provided with the cover 33, the supply tray 9 also serves as a tray for receiving ejected sheets. This makes the image recording apparatus 1 compact as a whole.

Since the cover 33 is formed with the cut 36 at the center in the width direction, an operator can easily pick out ejected sheets.

Further, pulling out the auxiliary support member 39 makes it possible to support ejected sheets so that they do not fall off. While not in use, the auxiliary support member 39 can be retracted and hence does not become an obstruction.

Also, the auxiliary support member 39 supports the leading edge of the sheet that has been subjected to the recording and the bulge 35 and the overhang 28 supports the trailing edge of the sheet. Thus, the ejected sheet can be reliably supported.

In addition, a tip end of the auxiliary support member 39 is capable of intersecting an imaginary plane extended substantially in parallel with the bottom plate 18 from the bu1ge 35 and the overhang 28. Thus, the ejected sheet can be reliably prevented from falling off the supply tray 9.

Further, the overhang 28 extends substantially in parallel with the bottom plate 18 with an interval therebetween. Therefore, a certain amount of sheets can be stacked on the supply tray 9.

Also, the pair of fixed side walls 32 are disposed on the bottom plate 18 and the cover 33 is detachably attached to the pair of side walls 32. Thus, the flexibility in designing the cover 33 is high.

In addition, the pair of side end guides 20R, 20L that restrict the side positions of the sheet has the overhang 28 at the upper portion thereof, and the auxiliary support member 39 is capable of intersecting an imaginary plane extended substantially in parallel with the bottom plate 18 from the overhang 28. Thus, the ejected sheet can be reliably supported.

Further, since the cover 33 has the bulge 35 located adjacently to the overhang 28, the rigidity of the cover 33 is improved.

Also, the bulge 35 extends in a direction perpendicular to the traveling direction of the sheet. Therefore, the rigidity of the cover 33 is further improved.

In addition, the overhang 28 has the stopper 29 on its side opposite to the bulge 35 to block the sheet from entering the recording unit. Thus, when recorded sheets that have been taken out once are returned onto the cover 33, the sheets can be prevented from entering the supply tray 9 through the gap above the overhang 28 and being sent to the recording unit again by pick-up unit.

Further, the auxiliary support member 39 is extendable and retractable with respect to the bottom plate 18 and is provided with the extension tray 39B that is extendable and retractable with respect to the auxiliary support member 39 and is capable of intersecting an imaginary plane extended substantially in parallel with the bottom plate 18 from the bulge 35 and the overhang 28. Thus, the ejected sheet can be reliably prevented from falling off the supply tray 9.

Also, the extension tray 39B intersects the imaginary plane in a state where the auxiliary support member 39 is extended from the bottom plate 18 and the extension tray 39B is extended from the auxiliary support member 39. Thus, the ejected sheet can be reliably prevented from falling off the supply tray 9.

Additionally the auxiliary support member 39 has, at its extending direction end portion, a hole 40 that opens to the bottom plate 18 at a center of the auxiliary support member 39. This makes the pulling out operation of the supply tray 9 easy.

Further, the extension tray 39B is capable of rotating about one end of the hole 40 and is supported by the other end of the hole 40 when rotated. Thus, the extension tray 39B can be moved in a stabilized manner.

Furthermore, since the supply tray 9 is detachably attachable to the apparatus main body 3, the operability for users is high.

The invention is not limited to the embodiment that has been described above with reference to the drawings, and the following embodiment, for example, is also included in the technical scope of the invention. Further, other various modifications can be practiced without departing from the spirit and scope of the invention. (1) Although the above embodiment is directed to the case that the supply tray can be attached to and detached from the apparatus main body, the invention can also be applied to a supply tray that can be pulled out of the apparatus main body but cannot be removed from the apparatus main body. That is, the invention can be applied to a supply tray that can be pulled out of the apparatus main body almost fully to supply new sheets and can thereafter be inserted again into the apparatus main body. Therefore, the term "supply tray capable of being pulled out of and inserted into the apparatus main body" includes not only a supply tray that can be attached to and detached from the apparatus main body but also a supply tray that is not detachable.

The invention relates to an image forming apparatus in which a cover that covers a top opening of a case for accommodating recording sheets used for a copier, a facsimile machine, a printer, or the like is used as a sheet ejection tray.

What is claimed is:

1. An image forming apparatus comprising:

a tray including a bottom surface configured to hold a sheet, an auxiliary support member and an upper plate disposed above the bottom surface;

a supply roller configured to supply the sheet from the bottom surface of the tray in a first direction; and a recording unit configured to record an image on the sheet supplied by the supply roller; and an output roller configured to eject the sheet having the image recorded thereon in a second direction opposite the first direction, the output roller being disposed above the bottom surface and downstream of the supply roller in the second direction, wherein the upper plate of the tray is disposed downstream of the output roller in the second direction and lower than the output roller, wherein the auxiliary support member is extendable with respect to the bottom surface beyond the upper plate in the second direction and is configured to receive, in cooperation with the upper plate, the sheet ejected by the output roller, and wherein the auxiliary support member, in an extended condition, is configured to intersect an imaginary plane extending from the upper plate in parellel with the bottom surface.

2. The image forming apparatus according to claim 1, wherein the auxiliary support member supports a leading edge of the sheet and the upper plate supports a trailing edge of the sheet ejected by the output roller.

3. The image forming apparatus according to claim 1, wherein the upper plate extends in parallel with the bottom surface with a space therebetween.

4. The image forming apparatus according to claim 1, wherein the tray further comprises a pair of walls disposed on the bottom surface; and the upper plate comprises a cover that is configured to be attached to and detached from the pair of walls.

5. The image forming apparatus according to claim 4, wherein the tray comprises a restriction member that restricts a position of at least one side of the sheet placed on the bottom surface and the restriction member has a roof at an upper portion thereof; and the auxiliary support member is configured to intersect an imaginary plane extending in parallel with the bottom surface from the roof.

6. The image forming apparatus according to claim 5, wherein the cover has a bulge at an upstream end thereof in the second direction which is closest to the roof.

7. The image forming apparatus according to claim 6, wherein the bulge extends in a direction perpendicular to the second direction.

8. The image forming apparatus according to claim 6, wherein the roof has a sheet blocking portion standing vertically at an upstream end of the roof in the second direction to block the sheet from moving from the cover to the bottom surface.

9. The image forming apparatus according to claim 1, wherein the auxiliary support member comprises:

a first portion that is extendable and retractable with respect to the bottom surface; and a second portion that is extendable and retractable with respect to the first portion and is configured to intersect an imaginary plane extending in parallel with the bottom surface from the upper plate.

10. The image forming apparatus according to claim 9, wherein the second portion intersects the imaginary plane in a state where the first portion is extended from the bottom surface and the second portion is extended from the first portion.

11. The image forming apparatus according to claim 1, wherein the auxiliary support member includes a first portion configured to slide from the bottom surface and a second portion configured to pivot with respect to the first portion.

12. The image forming apparatus according to claim 11, wherein the first portion has a hole that opens to the bottom surface, and the second portion pivots about a first end of the hole and is supported by a second end of the hole when pivoted.

13. The image forming apparatus according to claim 1, further comprising an apparatus main body;

wherein the tray is configured to be attached to and detached from the apparatus main body.

14. The image forming apparatus according to claim 1, wherein the auxiliary support member is extendable from and retractable to the bottom surface.

15. A sheet supply and output unit comprising:

a tray including a bottom surface configured to hold a sheet, an auxiliary support member, and an upper plate disposed above the bottom surface;

a supply roller configured to supply the sheet from the bottom surface of the tray toward a sheet path in a first direction; and an output roller configured to eject the sheet from the sheet path in a second direction opposite the first direction, the output roller being disposed above the bottom surface and downstream of the supply roller in the second direction, wherein the upper plate of the tray is disposed downstream of the output roller in the second direction and lower than the output roller, wherein the auxiliary support member is extendable with respect to the bottom surface beyond the upper plate in the second direction and is configured to receive, in cooperation with the upper plate, the sheet ejected by the output roller, and wherein the auxiliary support member, in an extended condition, is configured to intersect an imaginary plane extending from the upper plate in parallel with the bottom surface.

16. The sheet supply and output device according to claim 15, wherein the upper plate extends in parallel with the bottom surface with a space therebetween.

17. The sheet supply and output device according to claim 15, wherein the tray further comprises a pair of walls disposed on the bottom surface; and the upper plate comprises a cover that is configured to be attached to and detached from the pair of walls.

18. The sheet supply and output device according to claim 17, wherein the tray further comprises a restriction member that restricts a position of at least one side of the sheet placed on the bottom surface, the restriction member having a roof at an upper portion thereof, and wherein the auxiliary support member is configured to intersect an imaginary plane extending in parallel with the bottom surface from the roof.

19. The sheet supply and output device according to claim 18, wherein the cover has a bulge at an upstream end thereof in the second direction which is closest to the roof.

20. The sheet supply and output device according to claim 19, wherein the bulge extends in a direction perpendicular to the second direction.

21. The sheet supply and output device according to claim 19, wherein the roof has a sheet blocking portion standing vertically at an upstream end of the roof in the second direction to block the sheet from moving from the cover to the bottom surface.

22. The sheet supply and output device according to claim 15, wherein the auxiliary support member comprises:

a first portion that is extendable and retractable with respect to the bottom surface; and a second portion that is extendable and retractable with respect to the first portion and is configured to intersect an imaginary plane extending in parallel with the bottom surface from the upper plate.

23. The sheet supply and output device according to claim 22, wherein the second portion intersects the imaginary plane in a state where the first portion is extended from the bottom surface and the second portion is extended from the first portion.

24. The sheet supply and output device according to claim 15, wherein the auxiliary support member includes a first portion configured to slide from the bottom surface and a second portion configured to pivot with respect to the first portion.

25. The sheet supply and output device according to claim 24, first portion has a hole that opens to the bottom surface, and the second portion pivots about a first end of the hole and is supported by a second end of the hole when pivoted.

26. The sheet supply and output device according to claim 15, wherein the auxiliary support member is extendable from and retractable to the bottom surface.

* * * * *